US007493971B2

(12) United States Patent
Nevlud et al.

(10) Patent No.: US 7,493,971 B2
(45) Date of Patent: Feb. 24, 2009

(54) CONCENTRIC EXPANDABLE REAMER AND METHOD

(75) Inventors: Kenneth M. Nevlud, Spring, TX (US); Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 655 days.

(21) Appl. No.: 10/839,266

(22) Filed: May 5, 2004

(65) Prior Publication Data

US 2004/0222022 A1 Nov. 11, 2004

Related U.S. Application Data

(60) Provisional application No. 60/468,767, filed on May 8, 2003.

(51) Int. Cl.
*E21B 10/62* (2006.01)

(52) U.S. Cl. ..... 175/266; 175/269; 175/273; 175/279; 175/286; 175/291

(58) Field of Classification Search ..... 175/263, 175/265–271, 273, 274, 279, 284, 286, 290, 175/291, 325.4; 166/217
See application file for complete search history.

(56) References Cited

U.S. PATENT DOCUMENTS 3,224,507 A 12/1965 Cordary et al.
3,425,500 A 2/1969 Fuchs et al.
3,433,313 A * 3/1969 Brown ..... 175/270
3,974,886 A * 8/1976 Blake, Jr. ..... 175/269
4,055,226 A 10/1977 Weber
4,854,403 A * 8/1989 Ostertag et al. ..... 175/325.4
5,265,675 A 11/1993 Hearn et al.
5,351,758 A * 10/1994 Henderson et al. ..... 175/279
5,409,059 A * 4/1995 McHardy ..... 166/217

(Continued)

FOREIGN PATENT DOCUMENTS

EP 0301890 A3 2/1989

(Continued)

OTHER PUBLICATIONS

International Search Report for GB0410269.5, Aug. 19, 2004, Smith International, Inc.

(Continued)

*Primary Examiner*—Richard E Chilcot, Jr.
*Assistant Examiner*—Matthew J Smith
(74) *Attorney, Agent, or Firm*—Conley Rose, P.C.

(57) ABSTRACT

An expandable downhole tool comprises a tubular body, at least one moveable arm disposed within the tubular body and being radially translatable between a retracted position and a wellbore engaging position, and at least one piston operable to mechanically support the at least one moveable arm in the wellbore engaging position when an opposing force is exerted. A method of reaming a formation to form an enlarged borehole in a wellbore comprising disposing an expandable reamer in a retracted position in the wellbore, expanding at least one movable arm of the expandable reamer radially outwardly into engagement with the formation, reaming the formation with the at least one moveable arm to form the enlarged borehole; and mechanically supporting the at least one moveable arm in the radially outward direction during reaming.

55 Claims, 18 Drawing Sheets

U.S. PATENT DOCUMENTS

| | | | | |
|---|---|---|---|---|
| 6,039,131 | A | 3/2000 | Beaton | |
| 6,269,893 | B1 | 8/2001 | Beaton et al. | |
| 6,378,632 | B1 | 4/2002 | Dewey et al. | |
| 6,732,817 | B2 * | 5/2004 | Dewey et al. | 175/267 |
| 7,314,099 | B2 * | 1/2008 | Dewey et al. | 175/266 |
| 2003/0029644 | A1 | 2/2003 | Hoffmaster et al. | |
| 2003/0079913 | A1 * | 5/2003 | Eppink et al. | 175/267 |

FOREIGN PATENT DOCUMENTS

| | | | |
|---|---|---|---|
| EP | 0594420 | A1 | 4/1994 |
| GB | 2385344 | A | 8/2003 |
| WO | WO 00/31371 | A1 | 6/2000 |
| WO | WO01/29364 | A1 | 4/2001 |
| WO | WO 2004/097163 | A1 | 11/2004 |

OTHER PUBLICATIONS

Examination Report under Section 18(3) for UK Patent No. GB0410269.5, Nov. 8, 2005, 2 pgs.

* cited by examiner

CONCENTRIC EXPANDABLE REAMER AND METHOD

CROSS-REFERENCE TO RELATED APPLICATIONS

The present application claims the benefit under 35 U.S.C. § 119 of U.S. provisional application Ser. No. 60/468,767 filed May 8, 2003 and entitled "Concentric Expandable Reamer", hereby incorporated herein by reference for all purposes.

STATEMENT REGARDING FEDERALLY SPONSORED RESEARCH OR DEVELOPMENT

Not Applicable.

BACKGROUND OF THE INVENTION

1. Field of the Invention

The present invention relates generally to expandable downhole tools. More particularly, the present invention relates to a concentric expandable downhole tool having fewer components and thus a shorter length than conventional expandable tools. Still more particularly, the present invention relates to a robust, concentric expandable reamer having an advanced cutting structure and a mechanical/hydraulic activation mechanism.

2. Description of the Related Art

In the drilling of oil and gas wells, a plurality of casing strings are installed concentrically and then cemented into the borehole as drilling progresses to increasing depths. Thus, each new casing string is supported within the previously installed casing string, such that the largest diameter casing string is disposed at the uppermost end of the borehole and the smallest diameter casing string is disposed at the lowermost end of the borehole.

As successively smaller diameter casing strings are suspended, the annular area between the casing and the borehole wall is increasingly limited for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Further, by enlarging the borehole, the bottom of the formation can be reached with comparatively larger diameter casing, thereby providing a larger flow area for the production of oil and gas.

Various methods have been devised for passing a drilling assembly through an existing cased borehole and enlarging the borehole below the casing. One such method includes using a winged reamer behind a conventional drill bit. In such an assembly, a conventional pilot drill bit is disposed at the lowermost end of the drilling assembly with a winged reamer disposed at some distance behind the drill bit. The winged reamer generally comprises a tubular body with one or more longitudinally extending "wings" or blades projecting radially outwardly from the tubular body. Once the winged reamer has passed through any cased portions of the wellbore, the pilot bit rotates about the centerline of the drilling axis to drill a lower borehole on center in the desired trajectory of the well path, while the eccentric winged reamer follows the pilot bit and engages the formation to enlarge the pilot borehole to the desired diameter.

Another method for enlarging a borehole below a previously cased borehole section includes using a bi-center bit, which is a one-piece drilling structure that provides a combination reamer and pilot bit. The pilot bit is disposed on the lowermost end of the drilling assembly, and the eccentric reamer bit is disposed slightly above the pilot bit. Once the bi-center bit has passed through any cased portions of the wellbore, the pilot bit rotates about the centerline of the drilling axis and drills a pilot borehole on center in the desired trajectory of the well path, while the eccentric reamer bit follows the pilot bit and engages the formation to enlarge the pilot borehole to the desired diameter. The diameter of the pilot bit is made as large as possible for stability while still being capable of passing through the cased borehole. Examples of bi-center bits may be found in U.S. Pat. Nos. 6,039,131 and 6,269,893.

As described above, winged reamers and bi-center bits each include reamer portions that are eccentric. A number of disadvantages are associated with this design. In particular, due to directional tendency problems, these eccentric reamer portions have difficulty reliably enlarging the borehole to the desired diameter. With respect to a bi-center bit, the eccentric reaming section tends to cause the pilot bit to wobble and undesirably deviate off center, and any off-center rotation will cause the reaming section to drill an enlarged borehole that is undersized. A similar problem is experienced with respect to winged reamers, which only enlarge the borehole to the desired diameter if the pilot bit remains centralized in the borehole during drilling. Accordingly, it is desirable to provide a reamer that remains concentrically disposed in the borehole while enlarging the previously drilled borehole to the desired diameter.

There are several different types of concentric reamers, which are used in conjunction with a conventional pilot drill bit positioned below or downstream of the reamer. The pilot bit drills the borehole while the reamer follows to enlarge the borehole formed by the bit. One type of concentric reamer is a fixed-blade reamer, which includes a plurality of concentric blades (sometimes also referred to as arms) with cutters on the ends extending radially outwardly and spaced azimuthally around the circumference of the reamer housing. The outer edges of the blades contact the wall of the existing cased borehole, thereby defining the maximum reamer diameter that will pass through the casing, and also defining the maximum diameter of the enlarged borehole. Thus, although a fixed-blade reamer remains concentrically disposed as it rotates to enlarge the borehole, it is limited to enlarging the borehole only to the drift diameter of the existing cased borehole, whereas winged reamers and bi-center bits can enlarge the borehole beyond the drift diameter of the casing. Accordingly, a fixed-blade reamer often will not enlarge the borehole to the desired diameter.

More recently, concentric expandable reamers have been developed. Most expandable reamers have two operative states—a closed or retracted state, where the diameter of the tool is sufficiently small to allow the tool to pass through the existing cased borehole, and an open or expanded state, where one or more arms with cutters on the ends thereof extend from the body of the tool. In this latter position, the reamer enlarges the borehole diameter to the required size as the reamer is rotated and lowered in the borehole.

Expandable reamers are available in a variety of configurations, each having different activation mechanisms and blade configurations. One type of expandable reamer includes hinged arms with roller cone cutters attached thereto. This type of reamer may utilize swing out cutter arms that are pivoted at an end opposite the cutting end of the arms.

The cutter arms are actuated by mechanical or hydraulic forces acting on the arms to extend or retract them. Typical examples of this type of reamer are found in U.S. Pat. Nos. 3,224,507; 3,425,500 and 4,055,226, and they have several disadvantages. First, the pivoted arms may break during the drilling operation, requiring that the arms be removed or "fished" out of the borehole before the drilling operation can continue. Accordingly, due to the limited strength of the pivoted arms, this type of reamer may be incapable of under-reaming harder rock formations, or may have unacceptably slow rates of penetration. Further, if the pivoted arms do not fully retract, the drill string may easily hang up when attempting to remove it from the borehole. Therefore, it would be advantageous to provide a reamer that is more robust and has improved blade retraction mechanisms.

Other expandable reamers are activated by weight-on-bit to extend the blades. With such designs, the internal components of the reamer rather than the reamer body support the weight of drilling assembly components extending below the reamer. Accordingly, if too much weight is applied to the internal components, the reamer may not have enough hydraulic power to lift the weight below the reamer, and the reamer will not open. Further, it may not be possible to set weight-on-bit when the reamer should be activated to extend the blades. Also, during drilling, the weight-on-bit is sometimes unevenly distributed, and a false indication may be provided to the surface that the reamer blades are expanded when they are not.

Still other types of expandable reamers are activated by hydraulic or differential pressure, sometimes in combination with a mechanical component. With such designs, there is no certainty that all of the blades will be fully extended because the blades do not activate in unison. Therefore, one blade might extend while another blade is stuck in a partially extended position. Further, in some embodiments, drilling fluid pressure is the only force holding the blades in an extended position. Thus, if the strength of the formation is greater than the fluid pressure, the blades will partially retract and drill an undersized borehole. Some embodiments include a mechanical component, such as, for example, a piston with a continuously tapered surface that engages the blades to drive them radially outwardly as the piston moves downwardly. In such embodiments, the piston is activated by hydraulic pressure to drive the blades radially outwardly, but if the strength of the formation is greater than the fluid pressure, the blades will tend to retract along the continuously tapered surface. Thus, existing expandable reamers raise such concerns as whether the tool will expand to the desired borehole diameter when required, whether the tool will remain in the expanded position to enlarge the borehole to the desired diameter, and whether the tool will reliably retract prior to re-entering the casing as the drilling assembly is removed from the borehole.

Further, most expandable tools include a large number of moving parts, thereby increasing the probability of malfunction. The number of moving parts also affects the tool length, which may be up to 14 feet long, for example. There are also disadvantages associated with existing reamer blades. Specifically, to adjust the expanded diameter of the reamer, the entire arm must be removed and replaced, or in some cases, a different reamer may be required. Further, most blades fail to include pads on the gage configuration for stability and durability, or if pads are included, the blades fail to include active cutting structures near the pads.

The present invention addresses the deficiencies of the prior art.

SUMMARY OF THE INVENTION

In various embodiments, the concentric expandable tool that may be used as a reamer to enlarge the diameter of a borehole below a restriction, or alternatively, may be used as any other type of downhole expandable tool, such as a stabilizer, for example, depending upon the configuration of the blades.

An expandable downhole tool is disclosed for use with a drilling assembly in a wellbore comprising a tubular body, at least one moveable arm disposed within the tubular body and being radially translatable between a retracted position and a wellbore engaging position, and at least one piston operable to mechanically support the at least one moveable arm in the wellbore engaging position when an opposing force is exerted. In an embodiment, the piston is axially translatable in response to a differential pressure between an axial flowbore within the tool and the wellbore. In an embodiment, the moveable arm includes at least one set of cutting structures for reaming the wellbore in the wellbore engaging position. The moveable arm may also comprise a back-reaming cutter. The expandable downhole tool may further comprise at least one gage pad for stabilizing the drilling assembly in the wellbore engaging position. The gage pad may be removable and replaceable. Cutters may also be provided adjacent the at least one gage pad. In an embodiment, the tool further comprises a sliding sleeve biased to isolate the at least one piston from the axial flowbore, thereby preventing the at least one moveable arm from translating between the retracted position and the wellbore engaging position. A droppable or pumpable actuator may be provided for aligning the sliding sleeve to expose the at least one piston to the axial flowbore. In an embodiment, the tool further comprises at least one nozzle disposed adjacent the at least one moveable arm.

Also disclosed is a method of reaming a formation to form an enlarged borehole in a wellbore comprising disposing an expandable reamer in a retracted position in the wellbore, expanding at least one movable arm of the expandable reamer radially outwardly into engagement with the formation, reaming the formation with the at least one moveable arm to form the enlarged borehole; and mechanically supporting the at least one moveable arm in the radially outward direction during reaming. The method may further comprise back-reaming the formation with the at least one moveable arm. In an embodiment, the method further comprises flowing a fluid through the expandable reamer, and selectively driving the at least one movable arm radially outwardly in response to the flowing fluid. The method may further comprise mechanically retracting the at least one moveable arm radially inwardly. In an embodiment, the method further comprises flowing a portion of the fluid across a wellbore engaging portion of the at least one moveable arm. The method may further comprise providing a pressure indication during or after the at least one moveable arm is expanded radially outwardly. In an embodiment, the method further comprises providing stability and gage protection as the reaming progresses. The method may further comprise removing and/or replacing a formation engaging portion of the expandable reamer without removing the at least one moveable arm. In an embodiment, the expanding step is performed without substantially axially moving the expandable reamer within the wellbore.

Further, an expandable downhole tool is disclosed for use in a drilling assembly positioned within a wellbore comprising a tubular body including an axial flowbore extending therethrough, a piston disposed within the axial flowbore having at least one cam portion with a substantially flat surface, and at least one moveable arm engaging the piston, wherein the piston is axially translatable in response to a differential pressure between the axial flowbore and the wellbore, and wherein the at least one moveable arm is radially translatable between a retracted position and an expanded position. In an embodiment, the substantially flat surface on the cam portion engages a substantially flat surface on the at least one moveable arm in the expanded position. The at least one cam portion may further comprise a tapered piston surface that engages a tapered blade surface on the at least one moveable arm as the at least one moveable arm is radially translated from the retracted position to the expanded position. In an embodiment, the piston comprises a plurality of cam portions separated by at least one notch. The at least one moveable arm may comprise at least one blade portion that resides in the at least one notch in the retracted position.

The expandable downhole tool may further include a biasing spring to bias the at least one moveable arm to the retracted position. The biasing spring may comprise at least one radial spring. In various embodiments, the biasing spring is disposed in a spring chamber filled with fluid from the wellbore or in an oil-filled spring chamber. The at least one moveable arm may further comprise a tapered surface to engage a casing and radially translate the arm from the expanded position to the retracted position. The at least one moveable arm may include a plurality of cylindrical blades. In an embodiment, the blades comprise a fixed blade portion and a removeable blade portion. In various embodiments, the at least one moveable arm includes at least one set of cutting structures, at least one gage pad, a back-reaming cutter, or a combination thereof. In an embodiment, the tool comprises three moveable arms each having a gage surface area, which may include at least one cutting structure and at least one gage pad area. The combination of the gage surface areas of the three moveable arms may comprise a complete overlap of an aggressive cutting structure and a complete overlap of a smooth gage pad.

The tool may further comprise ports in fluid communication with the flowbore and the piston. In an embodiment, the tool further comprises a sliding sleeve biased to close the ports, thereby preventing the at least one moveable arm from translating between the retracted position and the expanded position in response to the differential pressure. A bullet actuator may be provided for aligning the sliding sleeve to open the ports. In an embodiment, the at least one moveable arm is radially translatable between the retracted position and the expanded position via a combination of hydraulic and mechanical activation. The tool may further comprise shear pins that prevent the at least one moveable arm from radially translating to the expanded position until the differential pressure is sufficient to break the shear pins. In an embodiment, the tool further comprises at least one nozzle disposed adjacent the at least one moveable arm. The tool may be shorter than about 14-feet, and in an embodiment, the tool is approximately 4-feet long.

Also disclosed is a drilling assembly comprising an expandable downhole tool wherein the tool is positionable anywhere on the drilling assembly upstream of the drill bit.

Thus, the concentric expandable tool comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the various embodiments of the concentric expandable tool, reference will now be made to the accompanying drawings, wherein.

DETAILED DESCRIPTION

Figure 1:
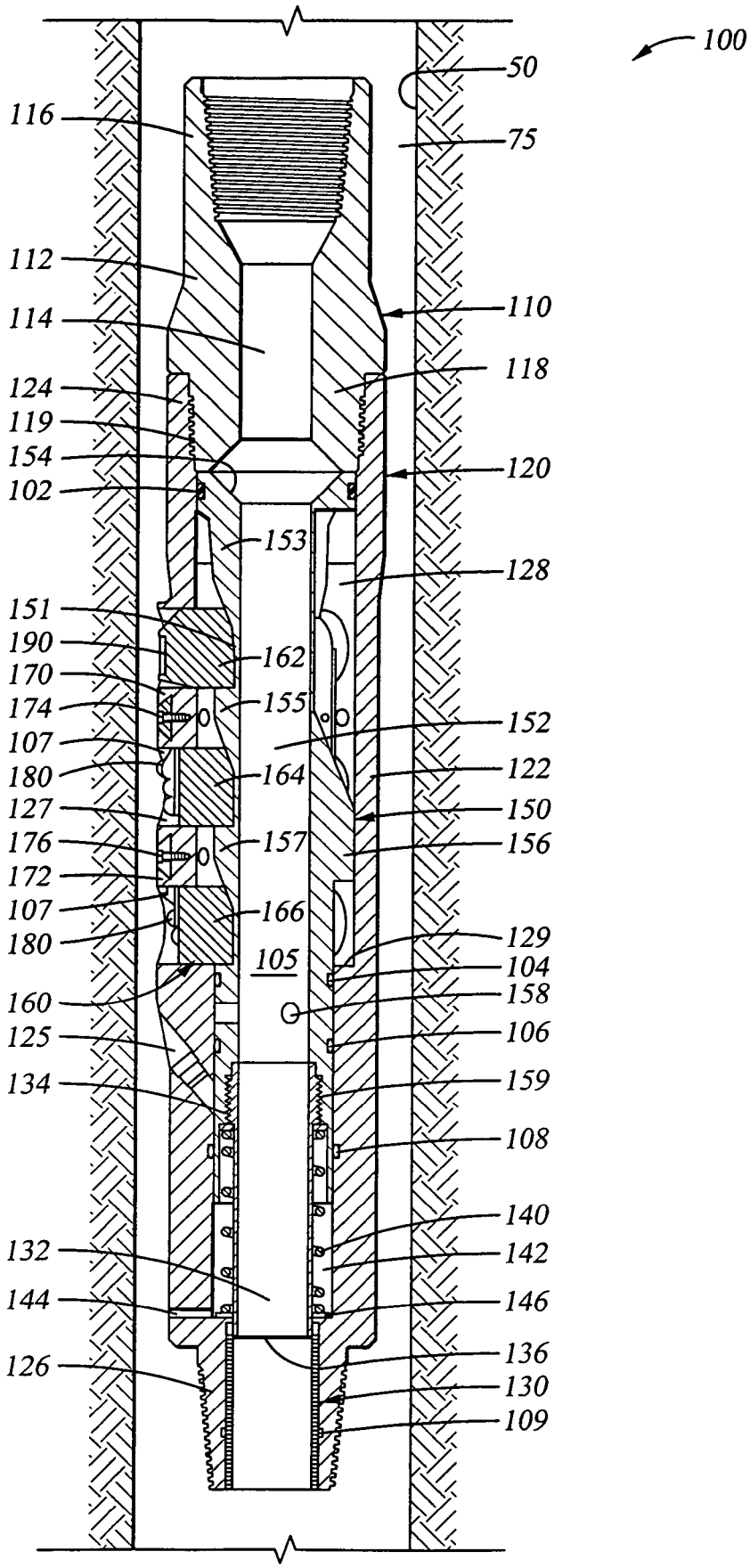
FIG. 1 is a cross-sectional side view of one embodiment of a concentric expandable tool with removeable arms in the retracted position.

The concentric expandable tool is susceptible to embodiments of different forms. There are shown in the drawings, and herein will be described in detail, specific embodiments of the tool with the understanding that the disclosure is to be considered an exemplification of the principles of the tool, and is not intended to limit the tool to that illustrated and described herein.

In particular, various embodiments of the concentric expandable tool provide a number of different constructions and methods of operation. Each of the various embodiments may be used to enlarge a borehole, or to perform another downhole function with an expandable tool, such as stabilization, for example. Thus, the concentric expandable tool may be utilized as a reamer, a stabilizer, or as any other type of expandable tool. The various embodiments of the tool also provide a plurality of methods for use in a drilling assembly. It is to be fully recognized that the different teachings of the embodiments disclosed herein may be employed separately or in any suitable combination to produce desired results.

Figure 2:
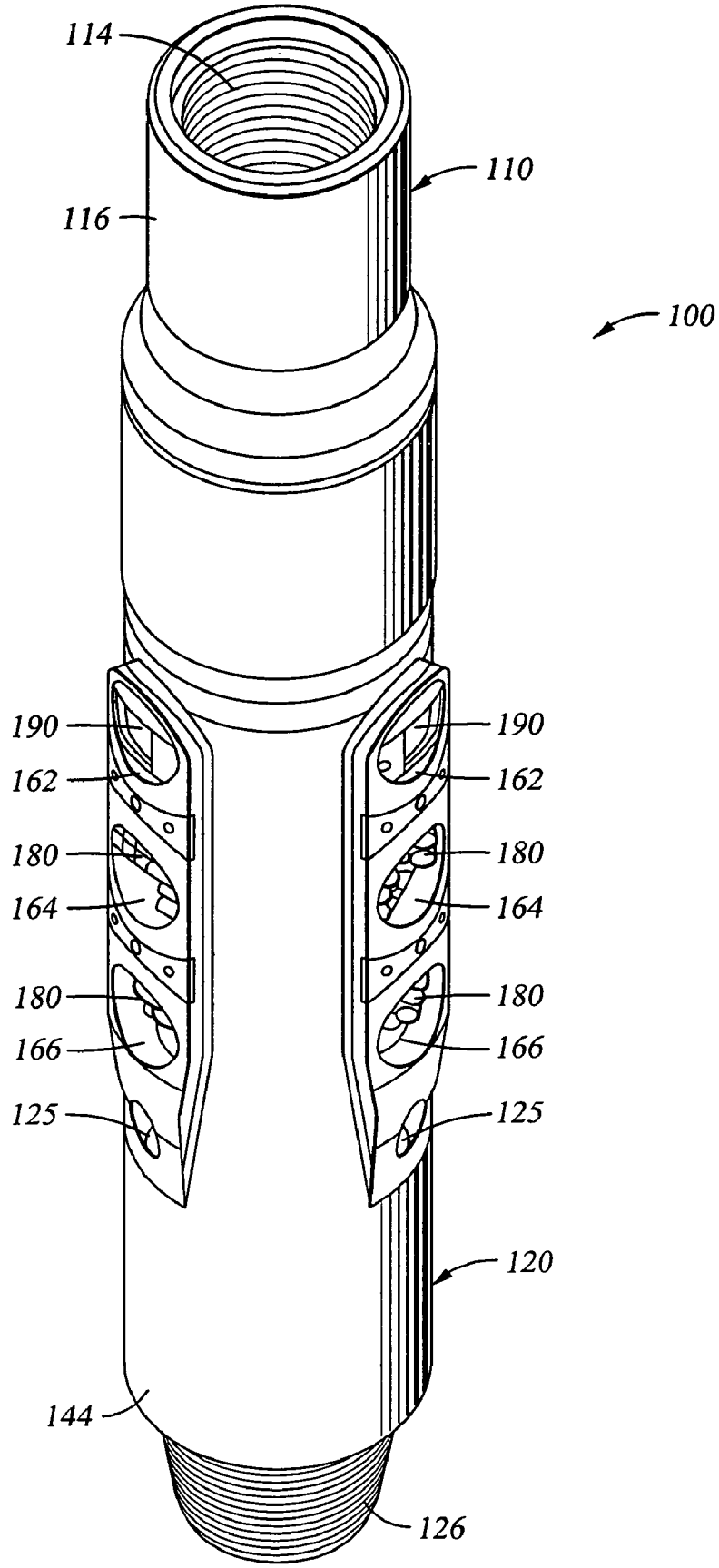
FIG. 2 is an external perspective view of the expandable tool of FIG. 1 in the retracted position.
Figure 3:
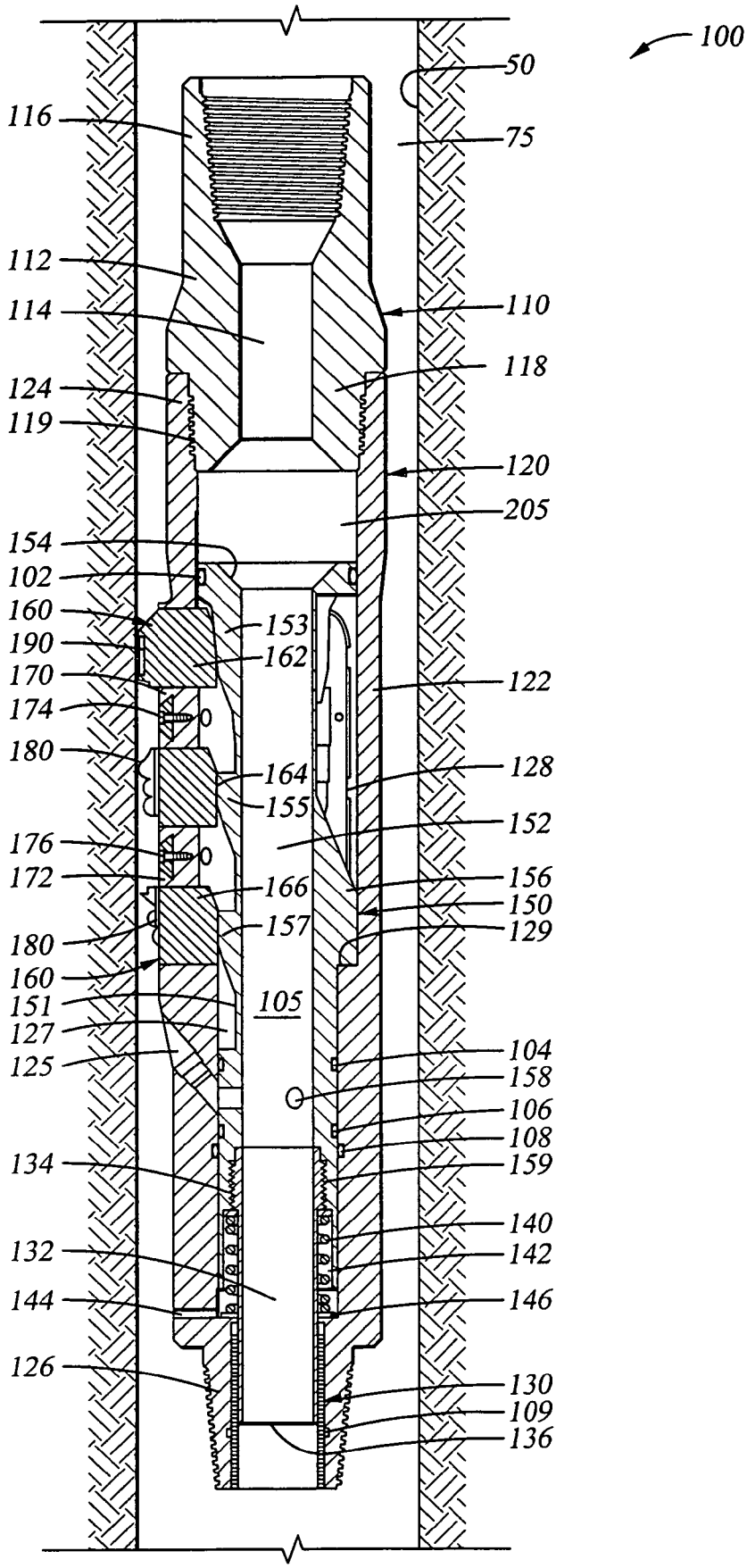
FIG. 3 is a cross-sectional side view of the expandable tool of FIG. 1, with the moveable arms in the expanded position.
Figure 4:
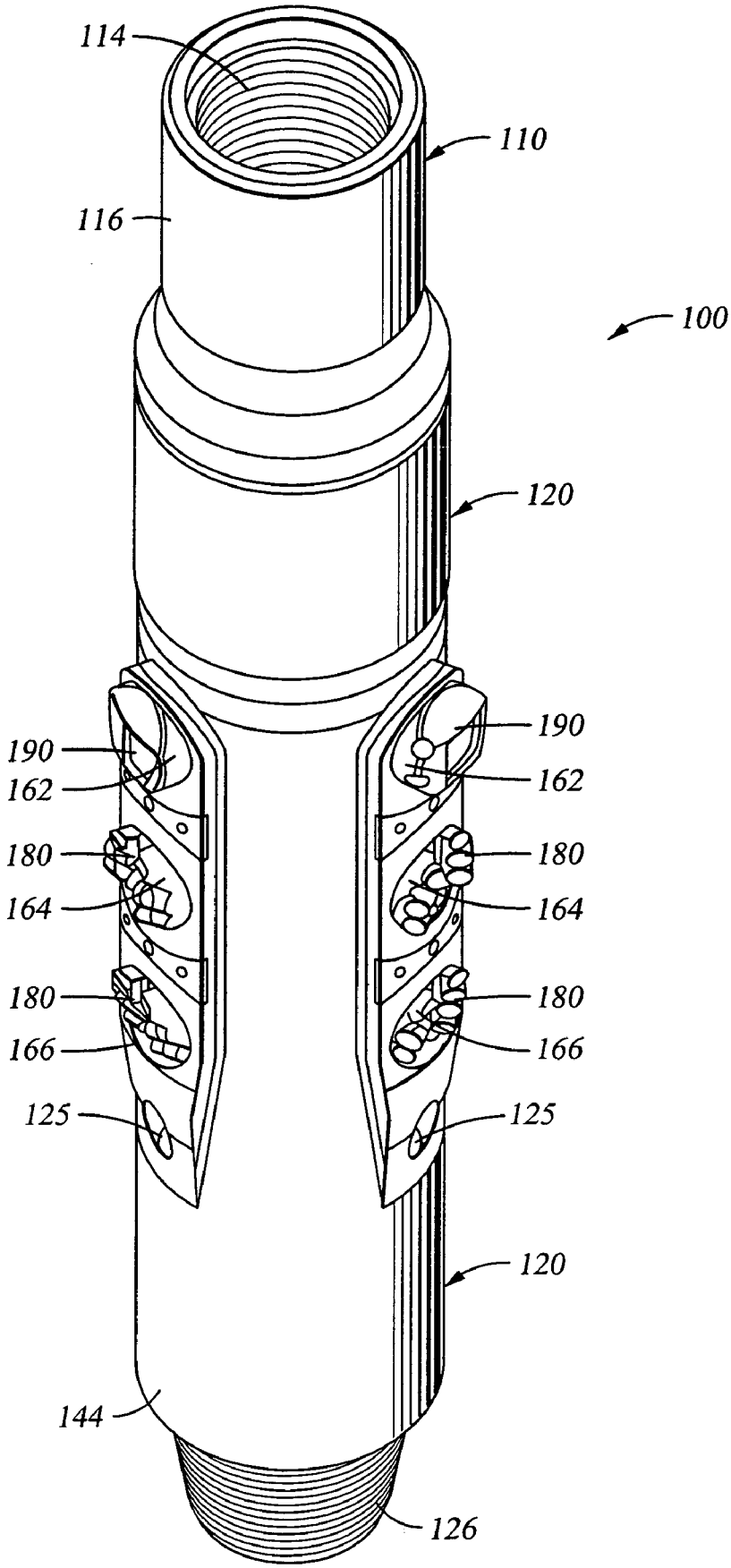
FIG. 4 is an external perspective view of the expandable tool of FIG. 1 in the expanded position.

FIG. 1 depicts a cross-sectional side view of one embodiment of an expandable tool, generally designated as 100, in the retracted position, and FIG. 2 depicts a perspective external view of the retracted tool 100. Similarly, FIG. 3 depicts a cross-sectional side view of the tool 100 in the expanded position, and FIG. 4 depicts a perspective external view of the expanded tool 100. FIG. 1 and FIG. 3 depict the tool 100 in a wellbore 50 thereby forming a wellbore annulus 75 between the tool 100 and the wellbore 50. The tool 100 comprises an upper section 110 with a flowbore 114 extending therethrough, a generally cylindrical tool body 120 with a flowbore 152 extending therethrough, and an internal sleeve 130 with a flowbore 132 extending therethrough. The flowbores 114, 152, 132 align axially to form a single flowbore 105 extending through the tool 100.

The upper section 110 includes upper and lower connection portions 116, 118 for connecting to a drill string (not shown) and the tool body 120, respectively. The tool body 120 includes upper and lower connection portions 124, 126 for connecting to the upper section 110 via threads 119 and a drilling assembly (not shown), respectively. The sleeve 130 is disposed within the lower connection end 126 of the tool body 120.

One or more outer pockets 127 are formed through the wall 122 of the body 120 and spaced apart azimuthally around the circumference of the body 120 to accommodate the radial movement of one or more moveable tool arms 160. Each pocket 127 stores one moveable arm 160 in the retracted position as shown in FIGS. 1-2. The arms 160 are biased inwardly to the retracted position by radial springs (not shown) disposed behind dovetail blocks 170, 172 that may have flow ports 174, 176 extending therethrough to allow fluid flow between the wellbore annulus 75 and the pockets 27. The flow ports 174, 176 may also be provided in other locations. Thus, the dovetail blocks 170, 172 retain radial springs that bias the arms 160 radially inwardly to the retracted position of FIGS. 1-2. In another embodiment, the dovetail blocks 170, 172 are eliminated, and the tool body 120 forms a solid section in the vicinity of the arms 160. In this embodiment, the arms 160 are biased inwardly to the retracted position by radial springs (not shown) disposed between the solid section of the tool body 120 and the arms 160. Preferably, the expandable tool 100 includes three moveable arms 160 disposed within three pockets 127, and spaced apart azimuthally at 120° from one another. In the discussion that follows, the one or more pockets 127 and the one or more arms 160 may be referred to in the plural form, i.e. pockets 127 and arms 160. Nevertheless, it should be appreciated that the scope of the present invention also comprises one pocket 127 and one arm 160.

The body 120 further includes an internal axial recess 128 to accommodate the axial movement of in internal piston 150 having an upper tapered surface 154 that engages the upper section 110 and connecting at its lower end to the sleeve 130 via threads 159. The piston 150 includes cam portions 153, 155, 157 that provide a drive mechanism for the moveable tool arms 160 to move radially outwardly to the expanded position of FIGS. 3-4. The piston 150 further includes a leg portion 156 that will engage a shoulder 129 at the lower end of the recess 128 in the body 120 when the piston 150 travels. Thus, the shoulder 129 limits the axial movement of the piston 150. The piston 150 sealingly engages the body 120 at 102, 104, 106, and the sleeve 130 sealingly engages the body 120 at 108, 109. The uppermost seal 102 and the lowermost seal 109 are pressure containing to prevent fluid from the flowbore 105 from getting into the internal recesses 128 and 142, respectively.

A biasing spring 140 is provided to bias the piston 150 upwardly, thereby moving the cam portions 153, 155, 157 away from engagement with the arms 160 so that the radial springs behind the dovetail blocks 170, 172 can bias the arms 160 to the retracted position of FIG. 1. Thus, the arms 160 are moved inwardly in a separate operation from the upward axial movement of the piston 150. The biasing spring 140 is disposed within a spring chamber 142 surrounding the sleeve 130, which is filled with drilling fluid that enters the spring chamber 142 from the wellbore annulus 75 via ports 144 extending through the wall 122 of the body. Because drilling fluid can enter the spring chamber 142 through ports 144, there is no need for a pressure compensation system for the biasing spring 140. Thus, as the biasing spring 140 collapses or expands, the ports 144 allow for volume changes within the spring chamber 142, as needed. The lower end of the biasing spring 140 engages a stop 146, and the upper end of the biasing spring 140 engages a shoulder 134 on the sleeve 130.

Below the moveable arms 160, one or more nozzles 125 extend at an angle through the wall 122 of the body 120. The number and position of nozzles 125 may correspond to the number and position of the arms 160, for example, or the nozzles 125 may be positioned away from the arms 160. The piston 150 includes apertures 158 that extend therethrough. With the tool 100 in the retracted position of FIGS. 1-2, the piston 150 blocks flow to the nozzles 125. However, when the tool 100 is in the expanded position of FIGS. 3-4, the apertures 158 in the piston 150 align with the nozzles 125 to allow fluid communication between the piston flowbore 152 and the wellbore annulus 75. Seals 104, 106 are provided around the apertures 158 to prevent fluid from flowing above and below the seals 104, 106 when the apertures 158 are aligned with the nozzle 125.

The moveable arms 160 include cylindrical blades 162, 164, 166 that fit within notches 151 in the piston 150 when the tool 100 is in the retracted position of FIGS. 1-2. The blades 162, 164, 166 are provided with structures 180, 190 that engage the borehole 50 when the arms 160 are extended outwardly to the expanded position of the tool 100 shown in FIGS. 3-4. In the expanded position, the arms 160 will ream the borehole 50 and/or stabilize the drilling assembly, depending upon how the blades 162, 164, 166 are configured. In the configuration of FIGS. 1-4, cutting structures 180 on blades 164, 166 ream the borehole 50, while a gage pad 190 on blade 162 provides stabilization and gage protection as the reaming progresses. Although the embodiment of tool 100 depicted in FIGS. 1-4 comprises three blades 162, 164, 166, a different number of blades may be provided on each arm 160. Providing three blades 162, 164, 166 with cutting structures 180 on two of the blades 164, 166 increases the cutting capacity of the tool 100 as compared to conventional tools, which typically have only one blade. All three of the blades 162, 164, 166 may include cutting structures 180 so that back-reaming capabilities are provided. Alternatively, the expandable tool 100 could easily be converted into a concentric, expandable stabilizer by providing gage pads 190 on all three blades 162, 164, 166 rather than cutting structures 180 on blades 164, 166.

During assembly, the arms 160 are positioned within the pockets 127 of the body 120. Then the piston 150 is installed so that the blades 162, 164, 166 reside within notches 151 between cam portions 153, 155, 157 on the piston 150. The sleeve 130 is threaded onto the piston 150 at 159 with the biasing spring 140 surrounding the sleeve 130. The biasing spring 140 pushes the piston 150 upwardly until the piston 150 engages the upper section 110, such that the biasing spring 140 is set to a certain preload. Then, radial springs (not shown) are provided between the cylindrical blades 162, 164, 166, and dovetail blocks 170, 172 are installed over the radial springs to hold the arms 160 into the retracted position.

In operation, the tool 100 is run into the borehole 50 through casing in the retracted position of FIGS. 1-2. In one embodiment, shear pins 107 are positioned through the body 120 around the blades 162, 164, 166 to retain the arms 160 in the retracted position as depicted in FIG. 1 until drilling fluid is pumped downhole at a pressure sufficient to break the shear pins 107. After the shear pins 107 break, the differential pressure between the flowbore 105 and the wellbore annulus 75 must overcome the force of the biasing spring 140. Then drilling fluid engaging the tapered surface 154 of the piston 150 will cause the piston 150 to move downwardly to expand the arms 160 as depicted in FIG. 3. The design of the shear pins 107 is rig dependent, such that the shear pin material and the number of shear pins 107 will be determined based upon the desired expansion pressure of a particular tool 100. In another embodiment, there are no shear pins 107 so that when pressurized drilling fluid reaches the tool 100, the piston 150 will move downwardly to extend the arms 160. Thus, the concentric expandable tool 100 will actuate when the differential pressure exceeds the force of the biasing spring 140 that pushes the piston 150 and the sleeve 130 upwardly.

Unlike conventional tools, the expandable tool 100 of FIGS. 1-4 utilizes hydraulic force as well as mechanical force to cause the arms 160 to extend outwardly from the retracted position of FIGS. 1-2 to the expanded position of FIGS. 3-4, and to maintain the arms 160 in the expanded position. When the drilling fluid flows through the flowbore 105 at a pressure sufficient to break the shear pins 107, and when the differential pressure between the flowbore 105 and wellbore annulus 75 is adequate to overcome the force of the biasing spring 140, then the piston 150 will move downwardly, thereby creating a gap 205 between the upper tapered surface 154 of the piston 150 and the upper section 110 as shown in FIG. 3. Each of the dovetail blocks 170, 172 has a port 174, 176 extending therethrough that allows fluid from the wellbore annulus 75 to flow into the recess 128 of the body 120. Therefore, the outer surface of the piston 150 is exposed to wellbore annulus pressure while the piston bore 152 is exposed to pump pressure from the surface. This difference in pressure drives the piston 150 downwardly within the recess 128, and as the piston 150 moves, the biasing spring 140 compresses, while the piston cam portions 153, 155, 157 push against the blades 162, 164, 166 to drive the arm 160 radially outwardly.

Figure 5:
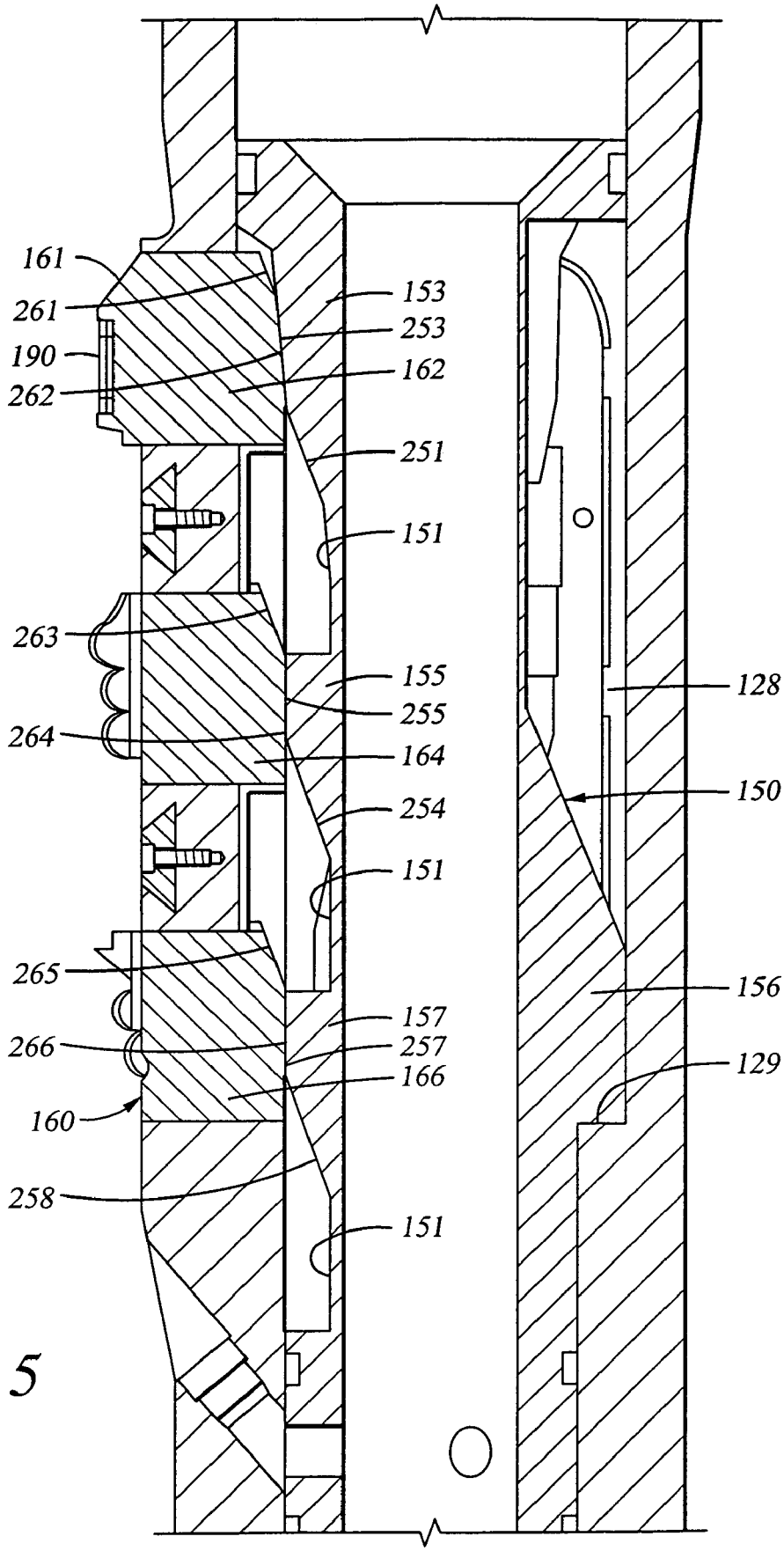
FIG. 5 is an enlarged, cross-sectional side view of a piston engaging blades on a moveable arm of the expandable tool of FIG. 1.

In more detail, FIG. 5 depicts an enlarged view of the piston 150 engaging a tool arm 160 in the extended position. Referring first to the piston 150, the cam portions 153, 155, 157 each preferably include a steep tapered surface 251, 254, 258, respectively, and a substantially flat surface 253, 255, 257, respectively. The steep tapered surfaces 251, 254, 258 may have a 20° taper, and the substantially flat surfaces 253, 255, 257 may have a slope ranging from approximately 0-5°, for example. With respect to the arms 160, the blades 162, 164, 166 each preferably include a tapered surface 261, 263, 265, respectively, and a substantially flat bottom surface 262, 264, 266, respectively. As depicted in FIG. 1, the blades 162, 164, 166 reside in notches 151 between the piston cam portion 153, 155, 157 when the arm 160 is in the retracted position. However, when the piston 150 begins to move downwardly, tapered blade surfaces 261, 263, 265 engage steep tapered piston surfaces 251, 254, 258, respectively to begin moving the arm 160 radially outwardly. The piston 150 will continue to move downwardly until the piston leg 156 engages the shoulder 129 within the body recess 128, which corresponds to the fully expanded position of the arm 160. Thus, the biasing spring 140 does not entirely support the weight of the piston 150, but rather the body 120 also supports the weight of the piston 150 at shoulder 129.

When the blades 162, 164, 166 are in the expanded position of FIG. 3 and FIG. 5, substantially flat surfaces 253, 255, 257 of the piston cam portions 153, 155, 157, respectively, engage substantially flat bottom surfaces 262, 264, 266 of the cylindrical blades 162, 164, 166, respectively. Thus, the substantially flat surfaces 253, 255, 257 of the piston 150 exert a mechanical force against the flat bottom surfaces 262, 264, 266 to hold the blades 162, 164, 166 in the expanded position. In contrast to conventional expandable tools that rely entirely on hydraulic pressure to hold the blades against the formation, the concentric expandable reamer 100 relies on hydraulic pressure to push the piston 150, but substantially flat surfaces 253, 255, 257 on the piston 150 mechanically act against the blades 162, 164, 166 to hold them in place as they cut into the formation. Thus, in terms of activation, the hydraulic pressure does not act directly on the arms 160 but rather acts on the piston 150, which then mechanically acts on the arms 160 to move them to the expanded position as well as maintain the arms 160 in the expanded position to ream the borehole 50.

In the expanded position of FIGS. 3-4, the nozzles 125 that extend at an angle through the wall 122 of the body 120 allow fluid to flow from the flowbore 105 into the wellbore annulus 75, and this achieves two purposes. Namely, when the piston 150 is moved downwardly to extend the arms 160, the piston apertures 158 align with the nozzles 125 in the body wall 122 so that fluid flows outwardly from the flowbore 105 of the tool to the wellbore annulus 75. Because the nozzles 125 are angled, fluid will flow across the blades 164, 166 to cool and clean the cutting structures 180. In addition, the operator at the surface will get an indication that the tool 100 is in the expanded position due to the pressure drop caused by the alignment of the apertures 158 and the nozzles 125 to allow fluid communication between the flowbore 105 and the annulus 75.

Once the surface pumps are shut off to remove the pressure on the expandable tool 100, the biasing spring 140 will exert a force upwardly against the shoulder 134 of the sleeve 130 to push the sleeve 130 and piston 150 upwardly. The cam surfaces 153, 155, 157 of the piston 150 thereby move upwardly so that the substantially flat portions 253, 255, 257 of the piston 150 no longer act against the substantially flat bottom surfaces 262, 264, 266 of the blades 162, 164, 166. The piston 150 moves to a position where the notches 151 are aligned with the blades 162, 164, 166, thereby providing a space for the arm 160 to move back into the retracted position of FIGS.

1-2. The radial springs (not shown) below the dovetail blocks 170, 172 actually force the arm 160 back into the retracted position. Thus, the piston 150 and sleeve 130 combination moves upwardly due to the force of biasing spring 140, and the arms 160 retract separately via another set of radial springs behind the dovetail blocks 170, 172.

The expandable tool 100 described above has several important features and advantages. For example, it solves the problems experienced with bi-center bits and winged reamers because it is designed to remain concentrically disposed within the borehole 50. In particular, the tool 100 preferably includes three extendable arms 160 spaced apart circumferentially at the same axial location on the tool 100. In one embodiment, the circumferential spacing would be 120° apart. This three-arm design provides a full gage reaming tool 100 that remains centralized in the borehole 50 at all times. Another feature of the expandable tool 100 is the ability to provide a hydraulic indication to the surface, thereby informing the operator whether the tool 100 is in the retracted position shown in FIGS. 1-2 or the expanded position shown in FIGS. 3-4. Further, the tool 100 has very few moving parts. In particular, only the piston 150, the sleeve 130, and the arms 160 move in contrast to other tools that may have as many as forty (40) moving parts. Thus, because there are comparatively fewer parts, and also because the arms 160 move radially rather than both radially and axially, the expandable tool 100 can be significantly shorter than conventional expandable tools. For example, the expandable tool 100 may be approximately 4-feet long as compared to other tools, which range up to approximately 14-feet long. Further, the tool 100 does not rely solely on a single activation technique to expand the arms 160 but instead combines hydraulic and mechanical activation techniques to provide a more robust activation mechanism. Since the tool 100 does not function solely by hydraulic pressure, the formation strength must overcome the mechanical strength of the blades 162, 164, 166 acting against the piston 150 in order to collapse the arms 160. Further, the blades 162, 164, 166 extend in unison because the piston 150 has three cam portions 153, 155, 157 that simultaneously engage the three cylindrical blades 162, 164, 166. In addition, the tool 100 is activated completely independently of weight-on-bit, such that the tool 100 components are not required to operate and support any devices beneath them simultaneously with expanding the tool 100, and allowing for the tool 100 to be placed anywhere within the drilling assembly.

Figure 6:
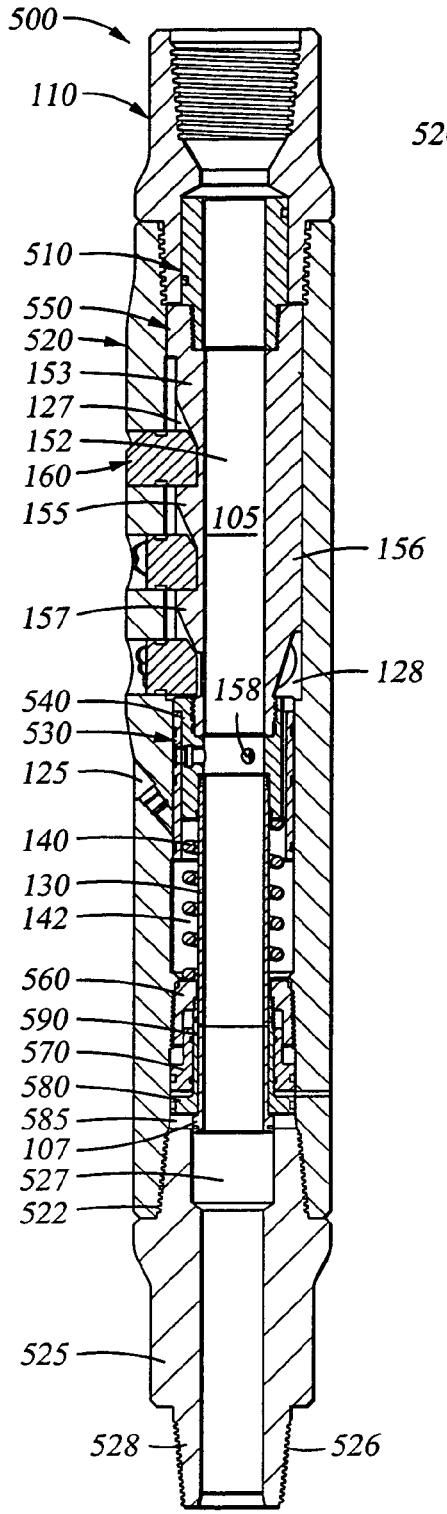
FIG. 6 is a cross-sectional side view of another embodiment of a concentric expandable tool with a pressure compensation system, with the moveable arms in the retracted position.
Figure 6A:
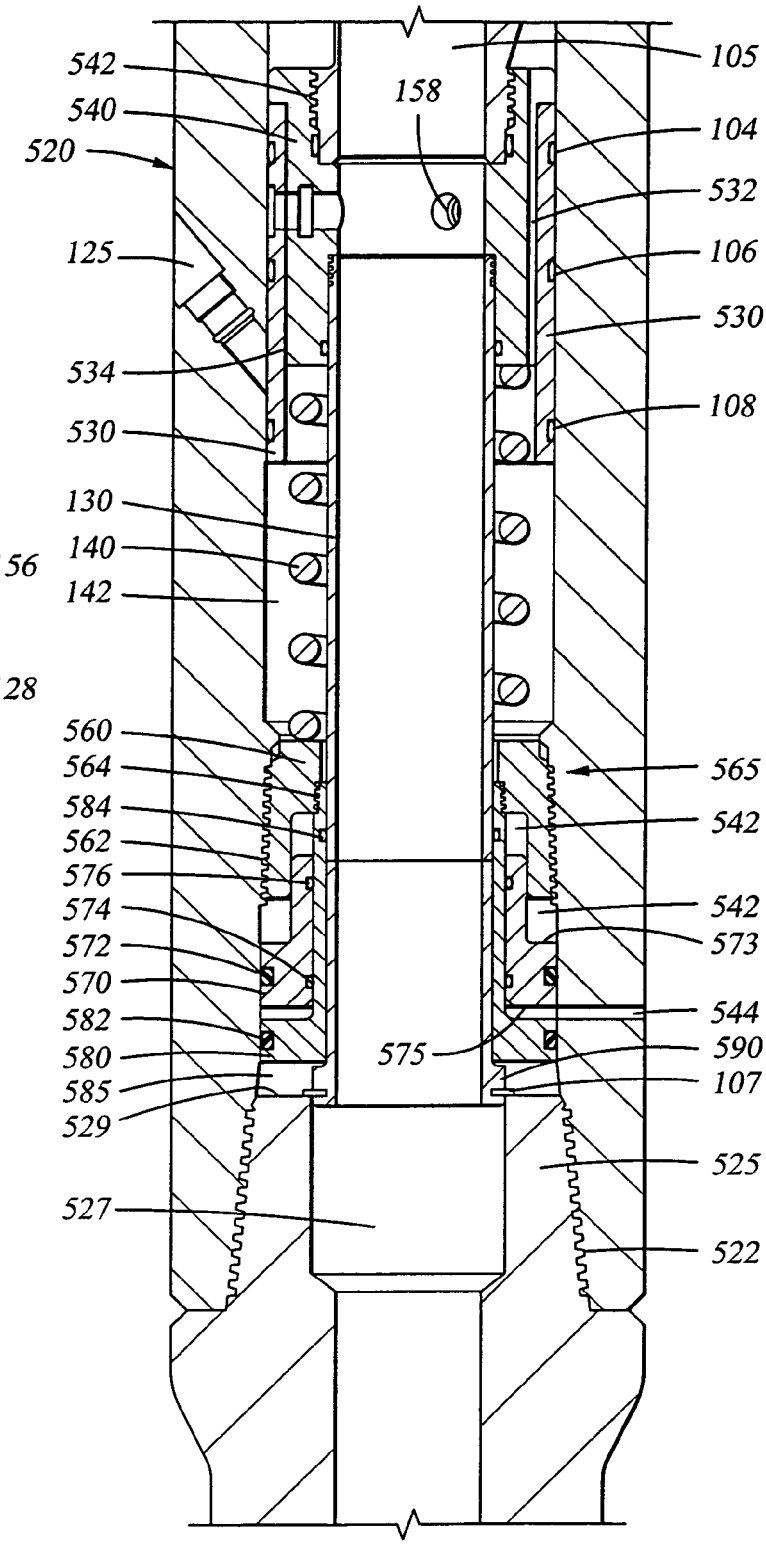
FIG. 6A is an enlarged, cross-sectional side view of a portion of FIG. 6.
Figure 7:
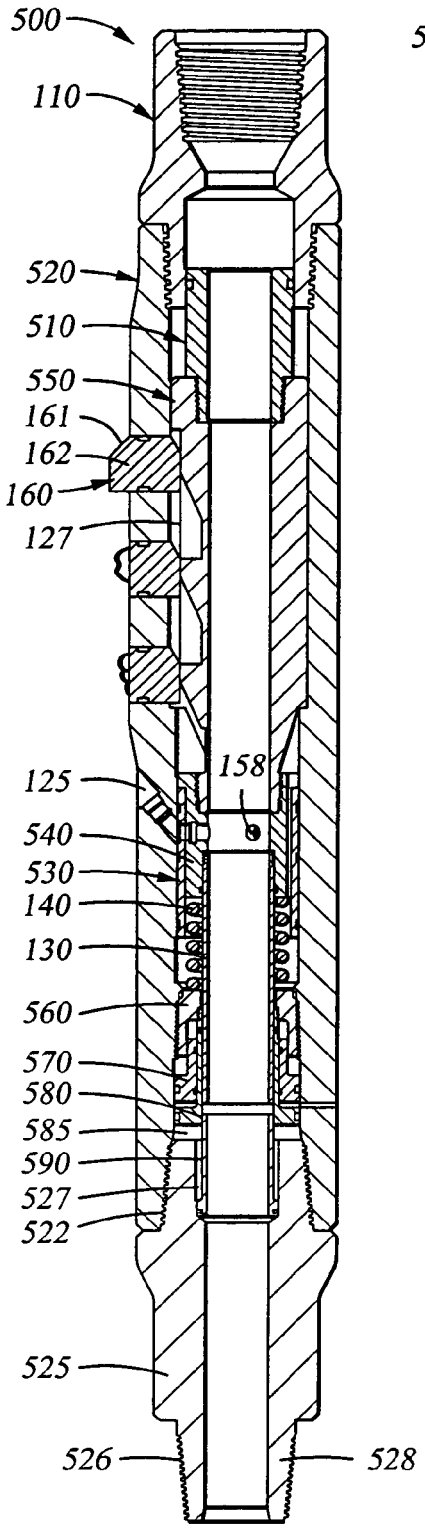
FIG. 7 is a cross-sectional side view of the concentric expandable tool of FIG. 6, with the moveable arms in the expanded position.
Figure 7A:
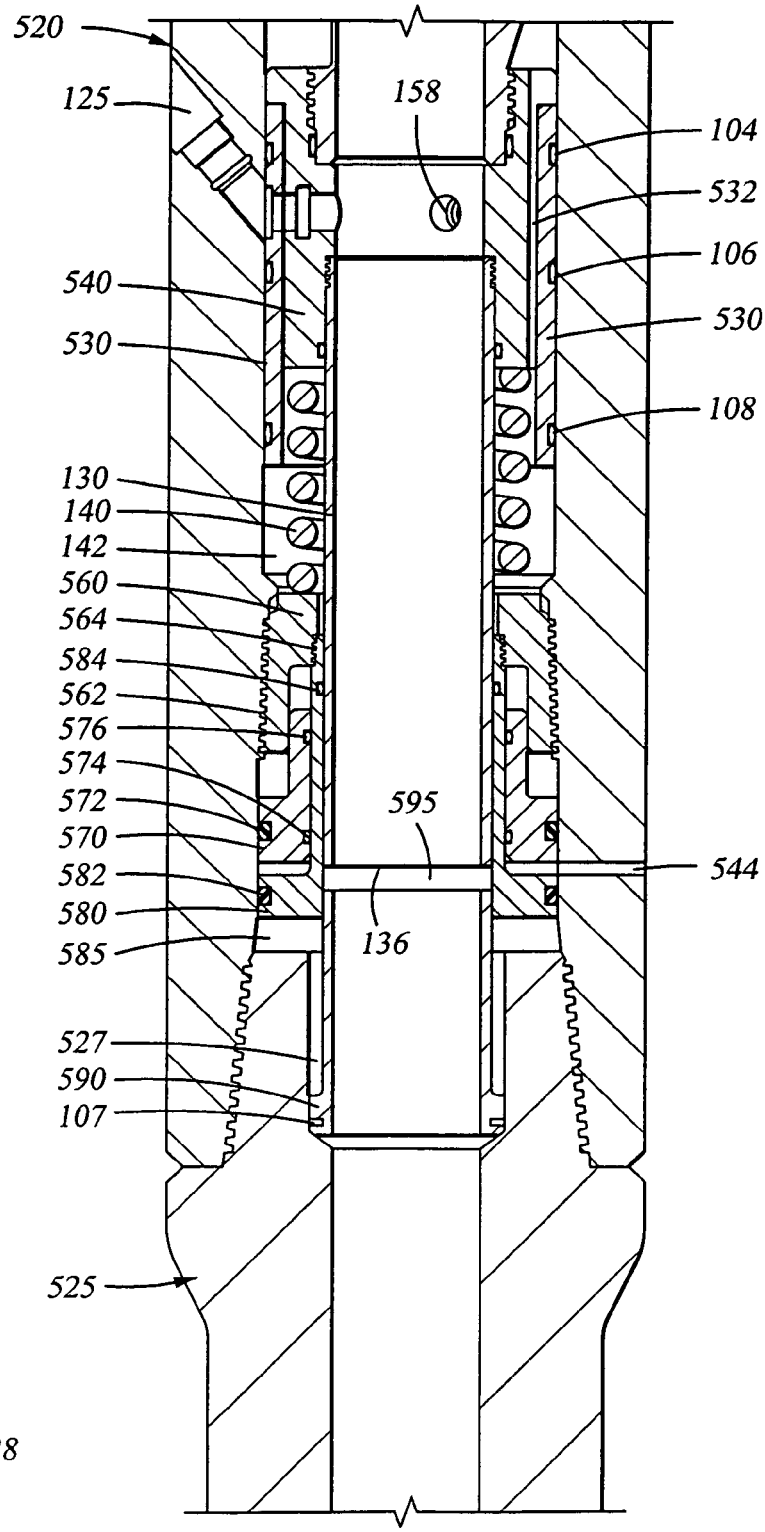
FIG. 7A is an enlarged, cross-sectional side view of a portion of FIG. 7.

Referring now to FIGS. 6-7, cross-sectional side views are depicted of a second embodiment of the present invention, generally designated as 500, in the retracted and expanded positions, respectively. FIG. 6A and FIG. 7A depict enlarged cross-sectional side views of a portion of FIG. 6 and FIG. 7, respectively, depicting the pressure-compensating features of the tool 500. Many components of the tool 500 are the same as the components of the first embodiment of the tool 100, and those components maintain the same reference numerals. There are, however, several differences, some of which may be incorporated into the first embodiment of the tool 100 as well. In particular, instead of a one-piece body 120 with a connection portion 126 for connecting to a drilling assembly component (not shown), either embodiment of the expandable tool 100, 500 may comprise a tool body 520 connected via threads 522 to a lower section 525. The lower section 525 includes a lower connection portion 528 for connecting via threads 526 to another component of the drilling assembly (not shown). When mating the tool 500 to another drilling assembly component, the lower section 525 or the threads 526 on the connection portion 528 could be damaged. When such damage occurs, the lower section 525 can easily be removed from the body 520 and replaced without having to replace the body 520 itself. Therefore, the lower section 525 is provided as a replaceable component that protects the tool body 520 from damage.

Further, instead of shear pins 107 being positioned at the arms 160, either embodiment of the expandable tool 100, 500 may include a shear sleeve 590 disposed within the tool body 520 below the spring sleeve 130 to retain shear pins 107. As shown in FIGS. 6 and 6A, when the tool 500 is in the retracted position, the shear pins 107 extend radially outwardly from the shear sleeve 590 to engage an upper surface 529 of the lower section 525.

In addition, instead of a one-piece piston 150, either embodiment of the expandable tool 100, 500 may comprise three separate components: a piston driver 550, a piston coupling 540, and an o-ring sleeve 530. The piston driver 550 connects to the piston coupling 540 via threads 542, and the o-ring sleeve 530 connects to the piston coupling 540 via threads 534. The piston driver 550 includes the cam portions 153, 155, 157 that drive the arms 160 outwardly, the piston coupling 540 includes the ports 158 that align with the nozzles 125 when the tool 500 is in the expanded position, and the o-ring sleeve 530 sealingly engages the tool body 520 at o-ring seals 104, 106, 108. Thus, these three piston components 550, 540, 530 are provided separately for ease of manufacturing and act together to perform essentially the same functions as the piston 150 depicted in FIGS. 1-4.

Unlike the tool 100 of FIGS. 1-4, the pressure-compensated tool 500 is entirely sealed and filled with oil rather than with drilling fluid from the wellbore annulus 75. Thus, rather than having ports 144 that extend through the wall 122 of the body 120 into the spring chamber 142 as depicted in FIGS. 1-4, the pressure-compensated tool 500 comprises a pressure compensation assembly 565 having a spring base 560 on the upper end, a compensation sleeve 580 on the lower end, and a floating compensation piston 570 therebetween. The spring base 560 connects via threads 562, 564 to the tool body 520 and to the compensation sleeve 580, respectively. The compensation sleeve 580 sealingly engages the tool body 520 and the spring sleeve 130 at seals 582, 584, respectively. The floating piston 570 sealingly engages the tool body at seal 572 and sealingly engages the compensation sleeve 580 at seals 574, 576.

The floating piston 570 comprises an upper surface 573 exposed to an oil-filled chamber 542 and a lower surface 575 exposed to fluid from the wellbore annulus 75 that enters the tool 500 through a port 544 extending through the tool body 520 above the compensation sleeve 580. Oil fills the tool 500 from the upper surface 573 of the floating piston 570, through the spring chamber 142, and through a gap 532 in the o-ring sleeve 530, into the pockets 127 and axial recess 128 within the tool body 520 to surround the piston driver 550. The port 544 allows for fluid from the wellbore annulus 75 to enter and exit the tool 500 to allow for volume changes in the oil-filled portion of the tool 500 as the arms 160 are expanded and retracted. The floating piston 570 has a certain stroke length within the chamber 542 to allow for volume displacement as the biasing spring 140 moves within the oil-filled spring chamber 142. Thus, the pressure compensation assembly 565 compensates for wellbore pressure and volumetric changes between the retracted position of the tool 500 as depicted in FIGS. 6 and 6A, and the expanded position of the tool 500 as depicted in FIGS. 7 and 7A.

In operation, the tool 500 is run into the wellbore 50 in the retracted position of FIG. 6 and 6A, and because the lower surface 575 of the floating piston 570 is exposed to wellbore annulus pressure via port 544, a force is exerted on the floating piston 570, thereby compressing the oil inside the tool 500. As drilling fluid is introduced from the surface into the flowbore 105 of the tool 500, differential pressure between the tool flowbore 105 and the wellbore annulus 75 will cause the piston driver 550, piston coupling 540, and spring sleeve 130 to exert a downward force on the shear sleeve 590 until the differential pressure is sufficient to break the shear pins 107. The shear sleeve 590 will then move downwardly into an enlarged bore area 527 of the lower section 525 as depicted in FIGS. 7 and 7A, thereby providing a gap 595 between the spring sleeve 130 and the shear sleeve 590. Meanwhile, the broken portions of the shear pins 107 will be trapped within an area 585 provided between the lower section 525 and the compensation sleeve 580. Then, as the piston driver 550 and piston coupling 540 move downwardly against the biasing spring 140 to extend the arms 160 as depicted in FIG. 7, oil from the spring chamber 142 flows into the oil-filled chamber 542 to exert pressure on the floating piston 570. Thus, the floating piston 570 will move axially while pushing drilling fluid out through the ports 544 into the annulus 75 to compensate for the volume change in the spring chamber 142.

When removing either embodiment of the expandable tool 100, 500 from the borehole 50, one of the failsafe mechanisms is the ability for the arms 160 to be collapsed should the radial springs behind the dovetail blocks 170, 172 fail. As best depicted in FIG. 3 and FIG. 7, the upper cylindrical blade 162 includes an upper tapered surface 161 that will engage casing if the arm 160 is still in the extended position as the tool 100, 500 is being raised out of the borehole 50. By engaging the casing on the tapered surface 161, the arm 160 will be forced inwardly as the tool 100, 500 is pulled upwardly through the casing.

Another failsafe withdrawal option would be to extend a grappling mechanism on a wireline through the tool bore 105 to attach to the lower end 136 of the spring sleeve 130 in case the biasing spring 140 should fail. The wireline pulls the piston 150 and spring sleeve 130, or alternatively, the piston driver 550, piston coupling 540 and spring sleeve 130 upwardly to align the piston notches 151 with the blades 162, 164, 166, thereby allowing the arms 160 to retract via the radial springs behind the dovetail blocks 170, 172.

If the substantially flat piston surfaces 253, 255, 257 are disposed at a slope greater than 0°, such as 5° for example, the arms 160 can be collapsed if the biasing spring 140 fails, or the radial springs fail, or both. In more detail, when the expandable tool 100, 500 is raised out of the borehole 50, the upper cylindrical blades 162 will engage the casing at tapered surface 161, and the force of the casing on the arms 160 will cause the blades 162, 164, 166 to act against the piston surfaces 253, 255, 257 having a 5° slope. The piston 150 or piston driver 550 will thereby be forced upwardly to align the piston notches 151 with the blades 162, 164, 166 so that the arms 160 may be retracted either by the radial springs or, if the radial springs have failed, by the force of the casing as the tool 100, 500 is pulled upwardly through the casing.

Accordingly, in various embodiments, the expandable tool 100, 500 is specifically designed not to get hung up in the borehole 50 or stuck in the expanded position.

Figure 8:
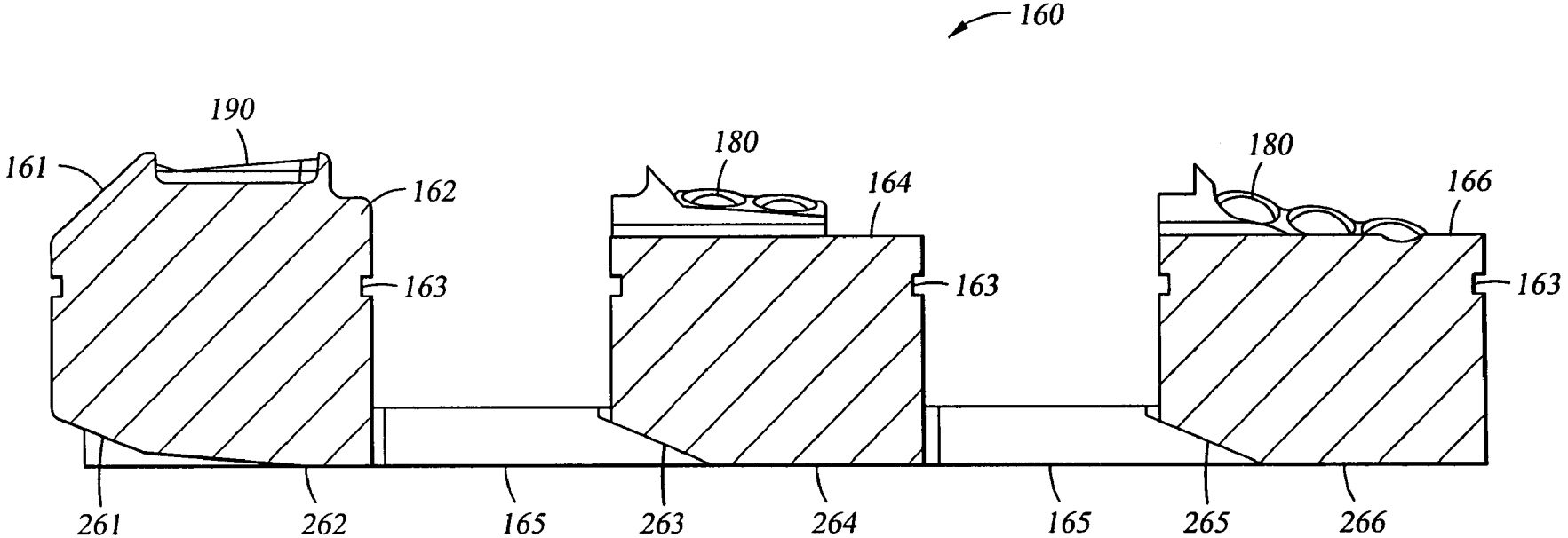
FIG. 8 is an enlarged cross-sectional side view of one embodiment of a moveable arm.
Figure 9:
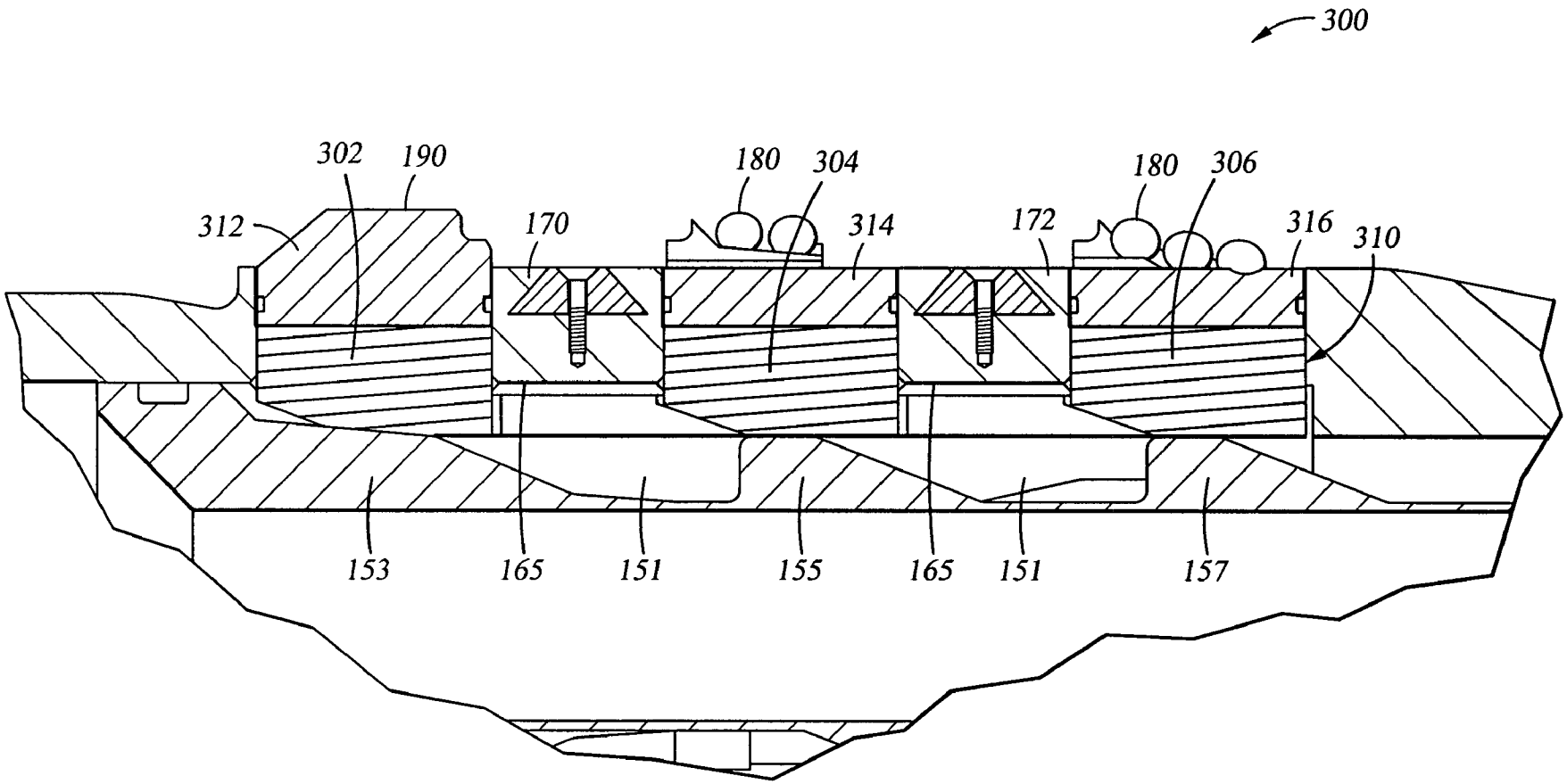
FIG. 9 is an enlarged cross-sectional side view of another embodiment of a moveable arm having removable blade portions.
Figure 10:
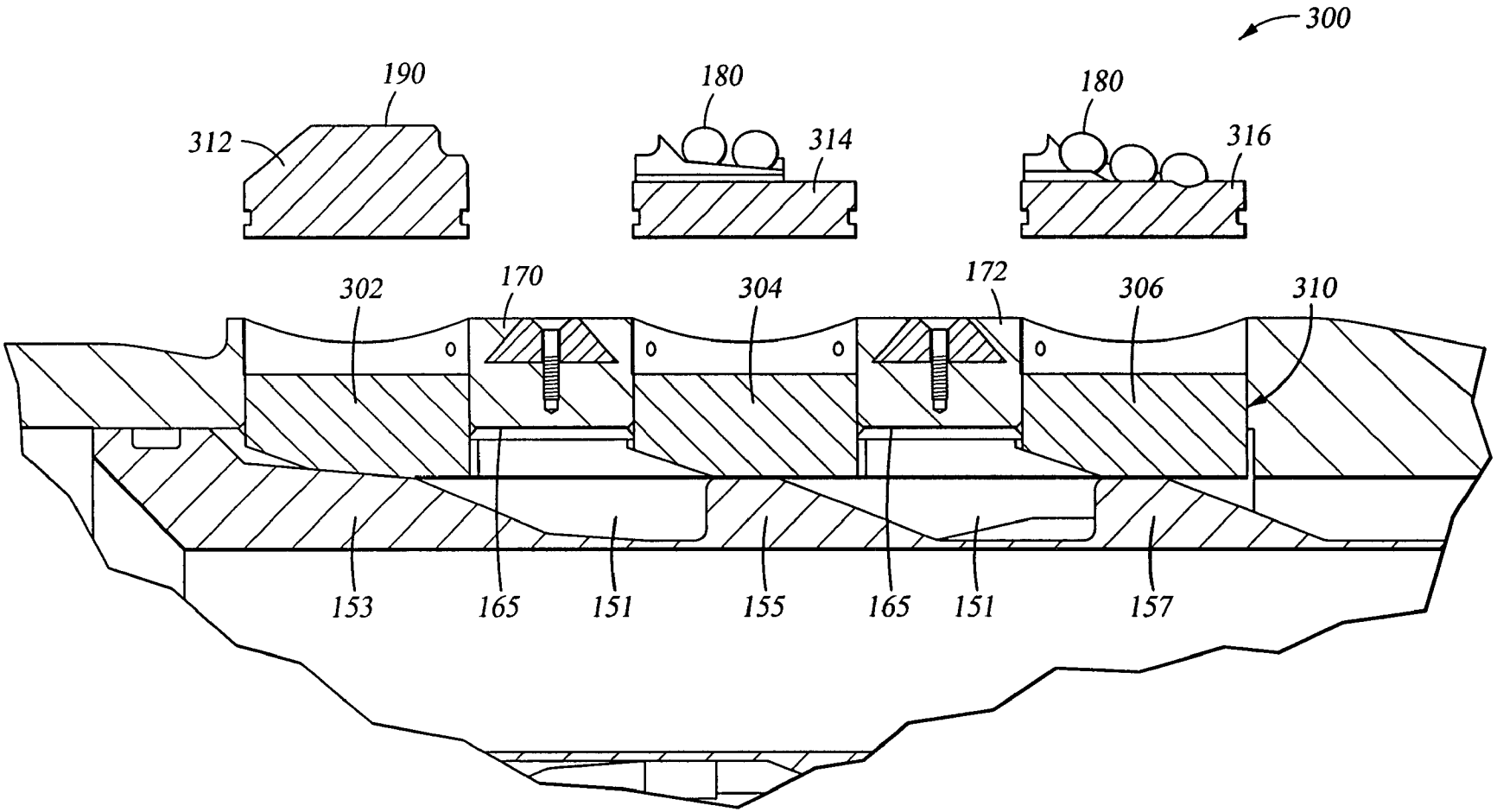
FIG. 10 is an enlarged cross-sectional side view of the moveable arm of FIG. 9, with the removable blade portions separated from fixed blade portions.

Referring now to FIG. 8, a cross-sectional side view of the moveable arm 160 is depicted in more detail. The arm 160 comprises a structural support beam 165 with one-piece blades 162, 164, 166 connected thereto. O-ring grooves 163 are provided on each of the blades 162, 164, 166. FIG. 9 depicts a cross-sectional side view of another embodiment of a moveable arm 300 that may be utilized instead of the moveable arm 160 in either embodiment of the expandable tool 100, 500. The moveable arm 300 comprises the same structural support beam 165, but instead of one-piece blades 162, 164, 166 connected thereto, the moveable arm 300 comprises fixed blade portions 302, 304, 306 connected to the support beam 165 and removable blade portions 312, 314, 316 connected to the fixed blade portions 302, 304, 306. Thus, the support beam 165 and fixed blade portions 302, 304, 306 form an internal arm 310 disposed within the body 120, 520 and the removable blade portions 312, 314, 316 can be detached from the internal arm 310 as shown in FIG. 10. There are several advantages to the alternative moveable arm 300. First, the removable blade portions 312, 314, 316 provide another possible failsafe for removing the tool 100, 500 from the borehole should the tool 100, 500 get stuck in the expanded position. In particular, by pulling the tool 100, 500 upwardly in the borehole 50, the removable blade portions 312, 314, 316 would engage the casing and simply shear off from the internal arm 310 so that the tool 100, 500 could then be removed.

The moveable arms 300 also allow for more flexibility to expand the tool 100, 500 to a different diameter. The internal arm portion 310 always moves radially outwardly by the same distance; whereas, the removable blade portions 312, 314, 316 may extend past the body 120, 520 and can be provided in different sizes depending upon the desired enlarged diameter of the reamed borehole. Thus, rather than replacing the entire standard moveable arm 160 every time an enlarged borehole diameter change is required, the operator could simply change the removable blade portions 312, 314, 316, and an inventory of various diameter sizes could be provided at the rig site. The removable blade portions 312, 314, 316 are comparatively small and inexpensive versus replacing an entire one-piece arm 160. For exemplary purposes, if the diameter of a standard expandable tool 100, 500 is approximately 8½ inches drift diameter, the tool 100, 500 may be capable of enlarging a borehole to approximately 9⅞ inches in diameter. To create a larger sized borehole, the removable blade portions 312, 314, 316 may extend past the body 120, 520 such that the drift diameter is in the range of 9⅞ inches, in which case the borehole could be enlarged to approximately 12¼ inches in diameter, for example. Thus, the moveable arms 300 always expand the same distance, but depending upon the size of the removable blade portions 312, 314, 316, the diameter of the reamed borehole can be changed accordingly.

Still another advantage of the alternative moveable arm 300 is that the pads 190 and cutting structures 180 can be optimized for a particular formation since the removable blade portions 312, 314, 316 can be removed and replaced easily. Accordingly, the removable blade portions 312, 314, 316 of the alternative moveable arms 300 could comprise a variety of structures and configurations utilizing a variety of different materials. When the tool 100, 500 is used in a reaming function, a variety of different cutting structures 180 could be provided, depending upon the formation characteristics. Preferably, the cutting structures 180 for reaming and back reaming are specially designed for the particular cutting function. More preferably, the cutting structures 180 comprise the cutting structures disclosed and claimed in co-pending U.S. patent application Ser. No. 09/924,961, filed Aug. 8, 2001, entitled "Advanced Expandable Reaming Tool," assigned to Smith International, Inc., which is hereby incorporated herein by reference for all purposes.

Figure 11C:
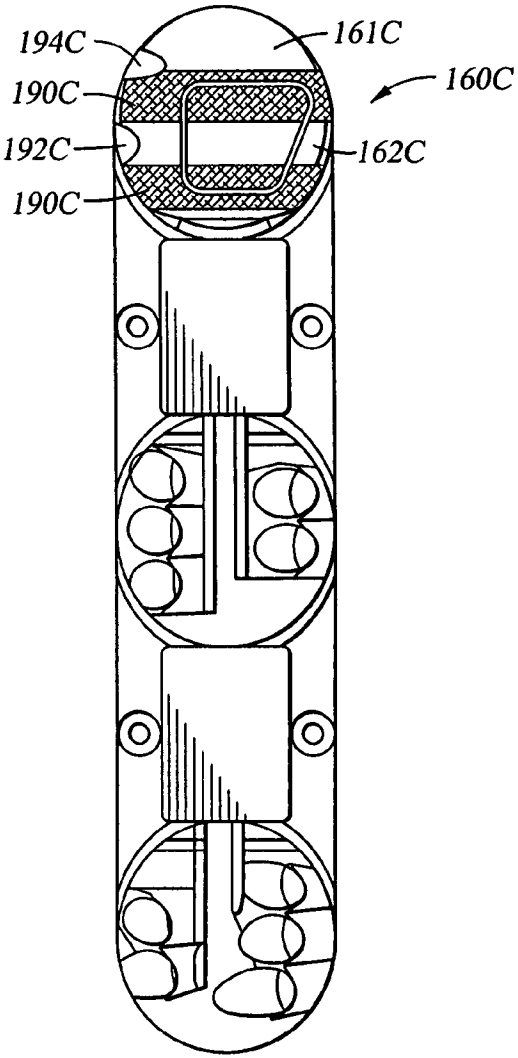
FIG. 11 is top plan view of three moveable arms with one embodiment of a gage configuration.
Figure 11B:
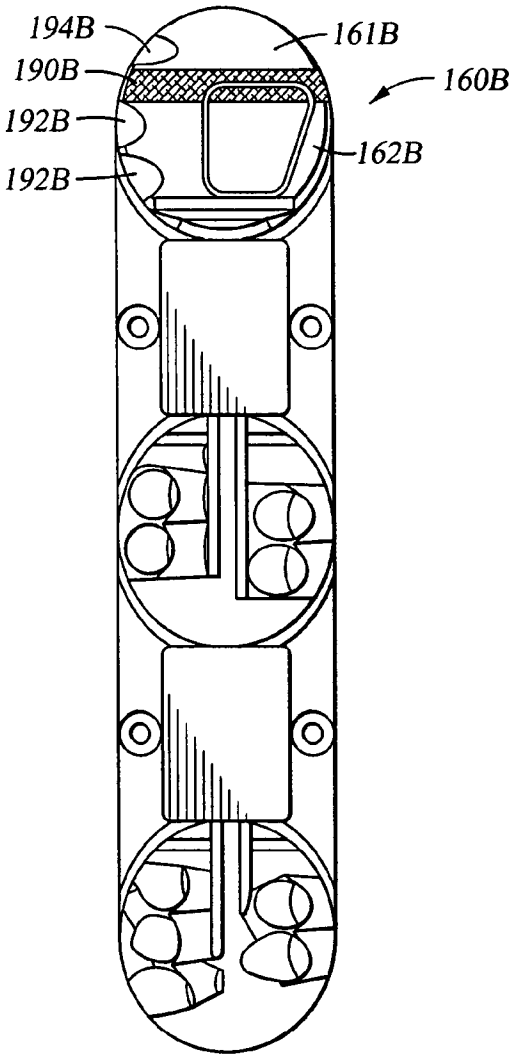
Figure 11A:
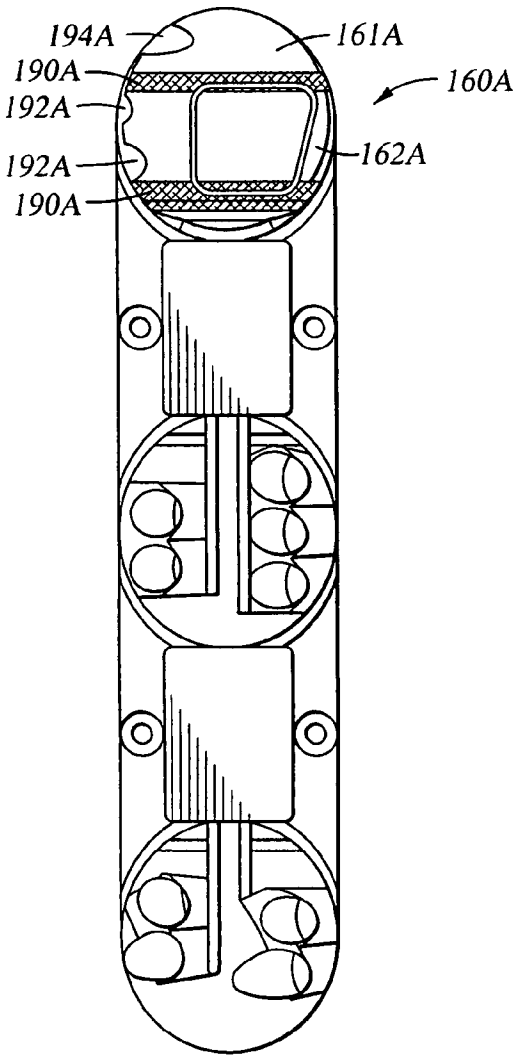

FIG. 11 illustrates another feature of the expandable tool 100, 500. In particular, unlike conventional expandable tools that either fail to include a gage pad 190, or fail to include cutting structures, such as cutters 192, near the gage pad 190, the present expandable tool 100, 500 allows excellent durability and stability. In particular, proper gage pads 190 are provided while also providing aggressive cutting structures 192 near the gage pad 190 so that either embodiment of the moveable arms 160, 300 can move from the retracted to the expanded position while the tool 100, 500 remains in the same axial location in the wellbore 50.

In more detail, FIG. 11 depicts a top plan view of three exemplary arms 160A, 160B, 160C disposed side by side for illustrative purposes. However, these arms 160A, 160B, 160C would actually be spaced apart azimuthally around the circumference of a tool body 120, 520. For the arms 160A, 160B, 160C to extend without drilling ahead in the borehole 50, an aggressive side cutting structure 192 must be provided. However, it is not desirable for the entire gage section provided by the combination of surfaces 162A, 162B, 162C to comprise an aggressive side-cutting structure 192 since this can lead to poor durability. Thus, FIG. 11 depicts one exemplary gage configuration designed to achieve aggressive side cutting while retaining good gage pad area for stability and durability. In particular, the gage surface 162A of expandable arm 160A includes an upper gage pad area 190A, two cutters 192A in the middle, and a lower gage pad area 190A. The gage surface 162B of expandable arm 160B includes a gage pad area 190B above two cutters 192B. The gage surface 162C of expandable arm 160C includes an upper gage pad area 190C, a single middle cutter 192C, and a lower gauge pad area 190C. Thus, the gage surfaces 162A, 162B, 162C of arms 160A, 160B, 160C, when combined, comprise a complete overlap of an aggressive cutting structure 192 and a complete overlap of a smooth gage pad 190 for stability and durability. In another embodiment, the gage surfaces 162A, 162C of arms 160A, 160C, respectively, could comprise all gage pad area 190, while the gage surface 162B of arm 160B could comprise all cutters 192. Various other configurations may also be provided to achieve the same purpose. Regardless of the configuration of the gage surfaces 162A, 162B, 162C, back-reaming cutters 194A, 194B, 194C may also be provided on upper tapered surfaces 161A, 161B, 161C of the three arms 160A, 160B, 160C, respectively. As one of ordinary skill in the art will readily understand, instead of the moveable arms 160A, 160B, 160C described above, the alternative moveable arms 300 could also be utilized.

FIGS. 12-15 depict enlarged cross-sectional side views of one embodiment of an exemplary bullet activation mechanism 600 for selectively expanding either embodiment of tool 100, 500 without using shear pins 107. In particular, FIGS. 13-16 depict a series of activation steps for the exemplary bullet activation mechanism 600, which is disposed in the flow bore 114 of the upper 110 section and extends into the flow bore 152 of the tool piston 150, 550. The bullet activation mechanism 600 comprises a sliding sleeve 650 biased upwardly by an axial spring 640 disposed in an oil-filled spring chamber 642. The sliding sleeve 650 comprises a plunger portion 655 with an internal tapered surface 654, a cylindrical body portion 656, and a flow bore 652 extending through both portions 655, 656. The sliding sleeve 650 extends into an internal recess 115 in the tool piston 150, 550, the recess 115 including a shoulder 117 to limit the downward movement of the sliding sleeve 650. The sliding sleeve 650 sealingly engages the upper section 110 at 604, 606 and sealingly engages the tool piston 150, 550 at 608. Ports 644 extend through the wall 112 of the upper section 110, providing fluid communication between the upper section flowbore 114 and a flat upper surface 605 of the tool piston 150, 550. A bullet 610 is the activation device and comprises a lower tapered surface 614, an upper flat surface 616, and a bore 612 extending therethrough.

Figure 12:
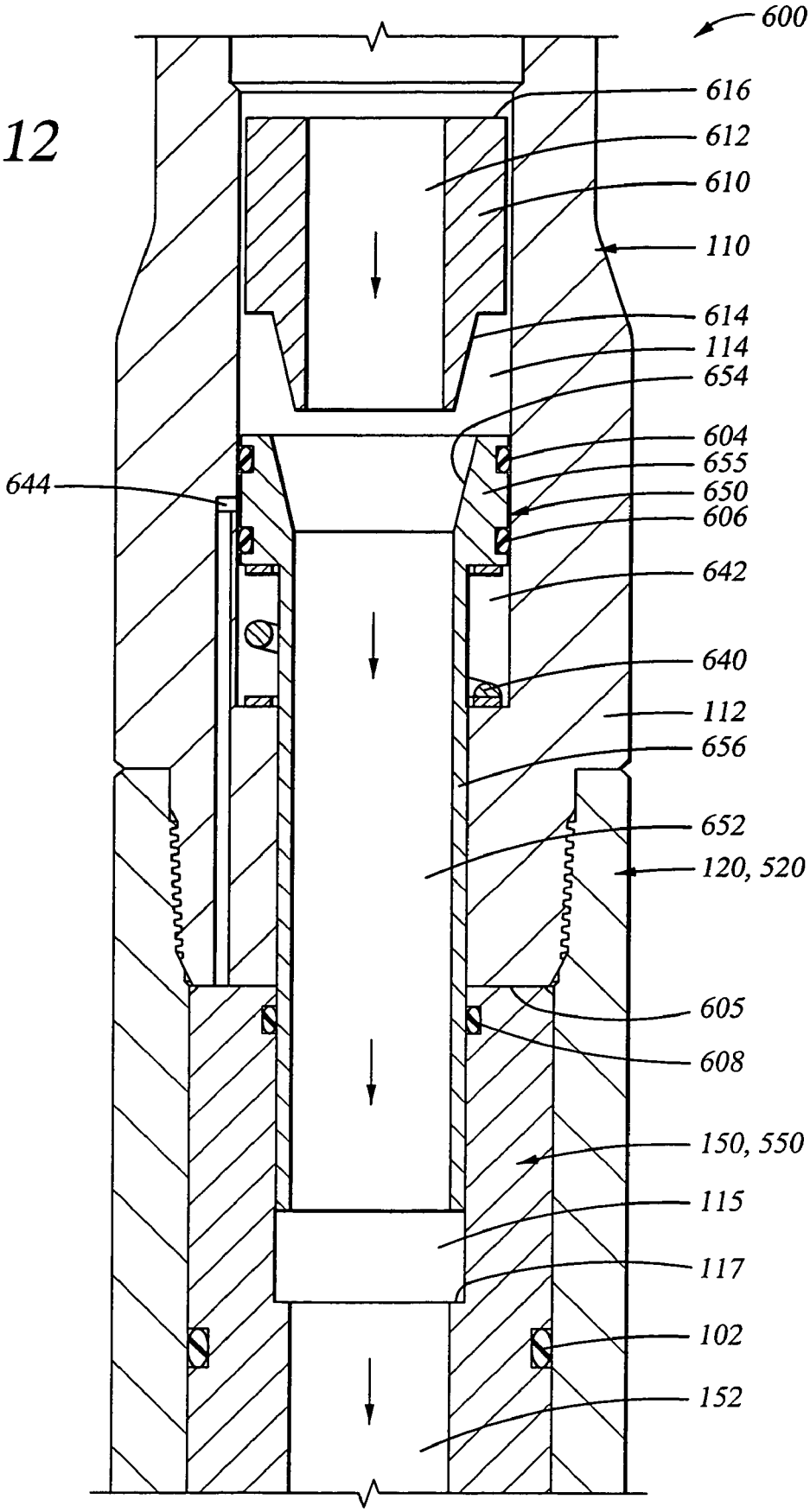
FIG. 12 is a cross-sectional side view of an exemplary bullet activation mechanism before a bullet has landed on a sliding sleeve.

FIG. 12 depicts the bullet activation system 600 with the sliding sleeve 650 and the piston 150, 550 in their uppermost positions, corresponding to the retracted position of the tool 100, 500. When the operator wants to activate the tool 100, 500 and expand moveable arms 160, 300, the bullet 610 is dropped into the wellbore from the surface. In FIG. 12, the bullet 610 has almost reached the sliding sleeve 650, which blocks the fluid ports 644 so that drilling fluid flows downwardly from the surface through the bullet bore 612, through the sliding sleeve bore 652, and through the piston flowbore 152 as depicted by the flow arrows. Thus, the piston 150, 550 has not moved downwardly to drive the arms 160 of the tool 100 radially outwardly from the retracted position.

Figure 13:
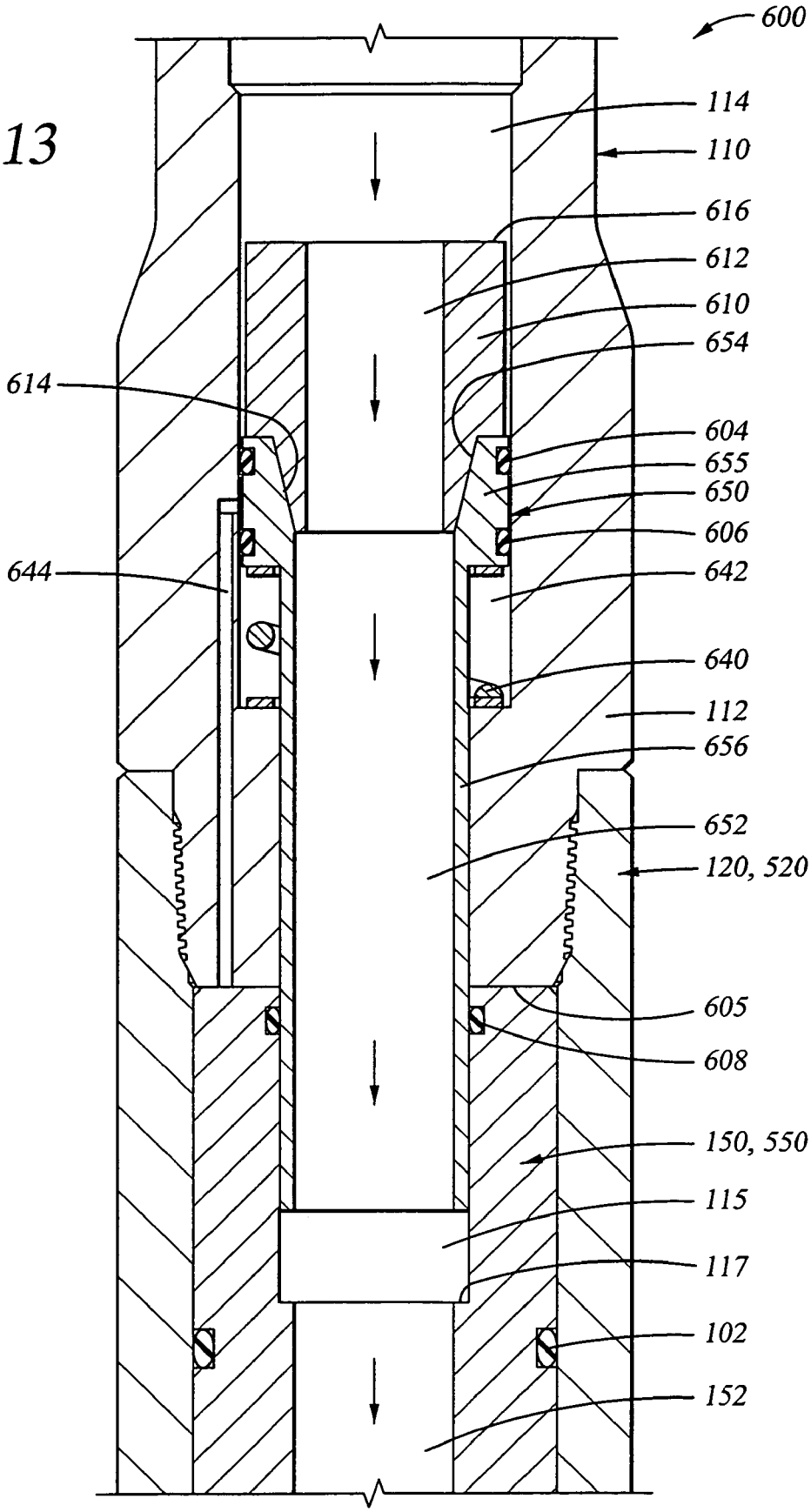
FIG. 13 is a cross-sectional side view of the bullet activation mechanism of FIG. 12 with the bullet seated on the sliding sleeve.

FIG. 13 depicts the bullet 610 just as the lower tapered bullet surface 614 seats on the upper internal tapered surface 654 within the plunger portion 655 of the sliding sleeve 650. In FIG. 13, the sliding sleeve 650 still blocks the fluid ports 644 so that the drilling fluid flows through the bullet bore 612, through the sliding sleeve bore 652, and downwardly through the piston flowbore 152 as depicted by the flow arrows. Thus, the piston 150, 550 has not moved downwardly to drive the arms 160 of the tool 100 radially outwardly from the retracted position.

Figure 14:
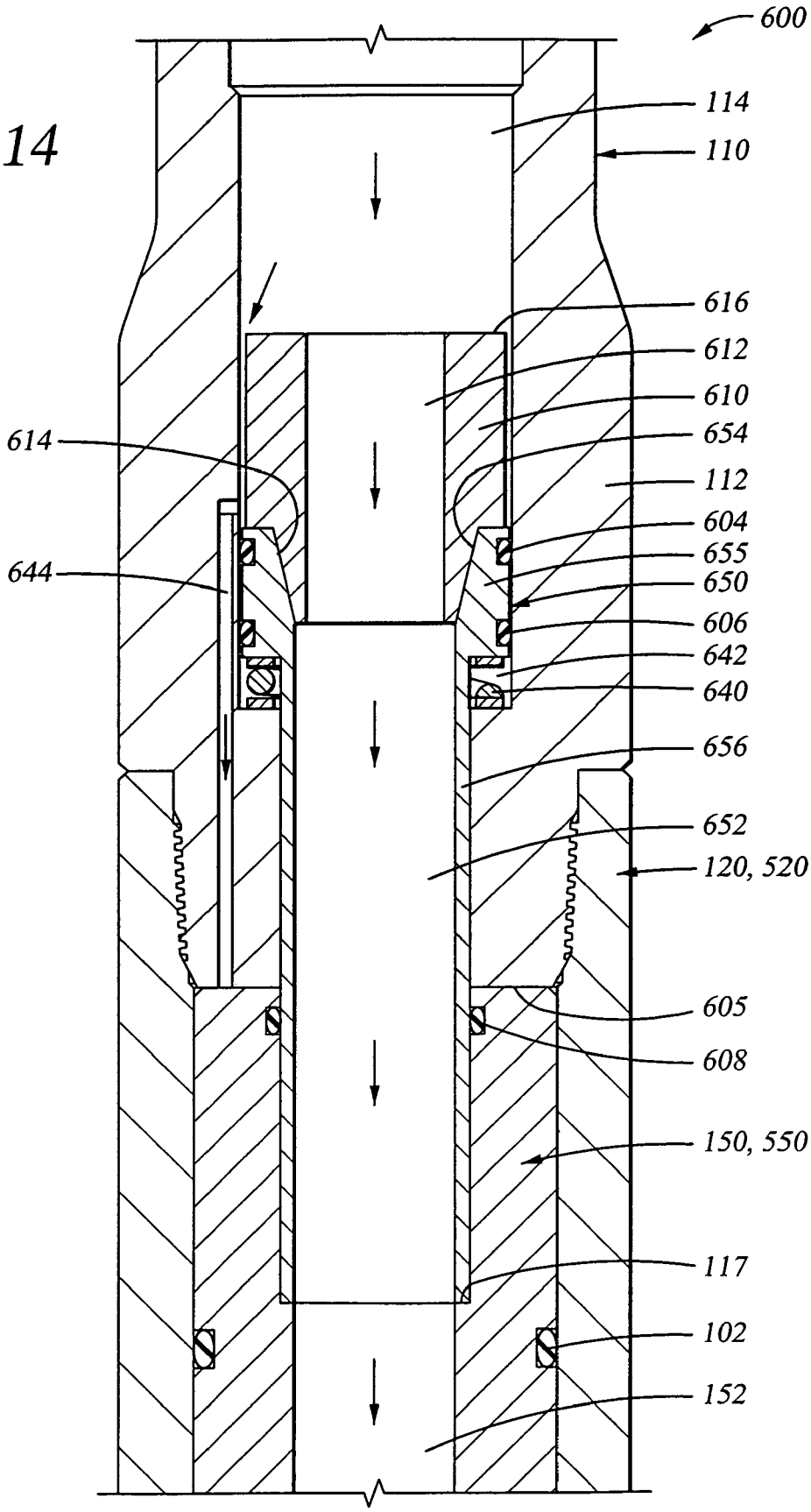
FIG. 14 is a cross-sectional side view of the bullet activation mechanism of FIG. 12 with the bullet driven downwardly to open fluid ports leading to the tool piston.

FIG. 14 depicts the bullet activation mechanism 600 after the bullet 610 has moved the sliding sleeve 650 downwardly due to pressure build up behind the bullet 610 from drilling fluid being pumped from the surface. Thus, the pressure of the drilling fluid on the flat upper surface 616 of the bullet 610, which is now seated on the sliding sleeve 650, causes the bullet 610 and sliding sleeve 650 to move downwardly against the axial spring 640. The sliding sleeve 650 will stop moving downwardly when the lower end of the sleeve body 656 engages the shoulder 117 within the recess 115 in the tool piston 150, 550. By moving downwardly, the sliding sleeve 650 opens the ports 644 so that a small amount of flow can move around the bullet 610 and into the ports 644 as depicted by the flow arrows in FIG. 14. The remaining fluid continues along the flow path through the bullet flowbore 612, through the sliding sleeve flowbore 652, and downwardly into the tool piston flowbore 152.

Figure 15:
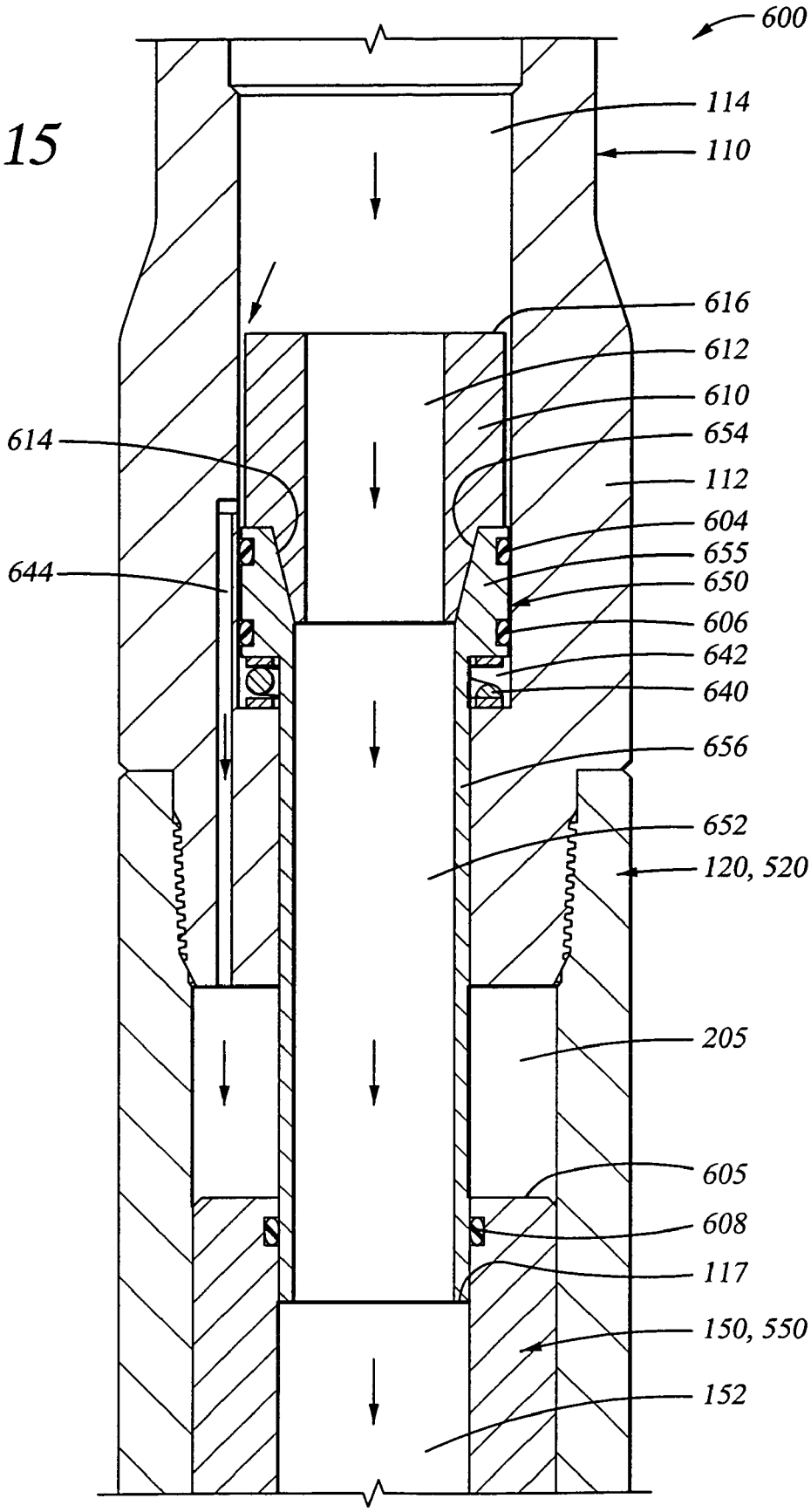
FIG. 15 is a cross-sectional side view of the bullet activation mechanism of FIG. 12 with the tool piston moved downwardly to expand the tool arms.

As depicted in FIG. 15, the pressure of the drilling fluid flowing through the ports 644 and acting against the upper surface 605 of the tool piston 150, 550 will cause the piston 150, 550 to move downwardly, thereby forming a gap 205 between the upper section 110 and the piston 150, 550. The downward movement of the piston 150, 550 expands the arms 160, 300 of the tool 100, 500 as previously described. In summary, when the bullet 610 is not seated on the sliding sleeve 650, the fluid will flow directly through the tool 100, 500 so that the arms 160 will not expand. However, when the bullet 610 is dropped into the borehole 50 and seats with the sliding sleeve 650, pressure on the upper surface 616 of the bullet 610 will force the bullet 610 and sliding sleeve 650 down, thereby opening lateral ports 644 through the upper section wall 112 to allow fluid pressure to engage the upper surface 605 of the piston 150, 550. This fluid pressure causes the piston 150, 550 to move downwardly and extend the arms 160 to the expanded position. Thus, the bullet activation mechanism 600 eliminates the need for shear pins 107 because the piston 150, 550 will not actuate until the bullet 610 is dropped into the borehole 50 and seats on the sliding sleeve 650.

In another embodiment, the bullet 610 has no bore 612 therethrough such that when the bullet 610 seats on the sliding sleeve 650, all flow is blocked through the tool until the bullet 610 and sliding sleeve 650 move downwardly to open ports 644, and then flow through the ports 644 causes the piston 150, 550 to move downwardly away from the upper section 110. In yet another embodiment, there are no ports 644 through the upper section 110, and the sliding sleeve 650 either engages or connects to the tool piston 150, 550. In this embodiment, when the bullet 610 seats on the sliding sleeve 650, the sliding sleeve 650 will move downwardly, thereby causing downward movement of the tool piston 150, 550.

Figure 16:
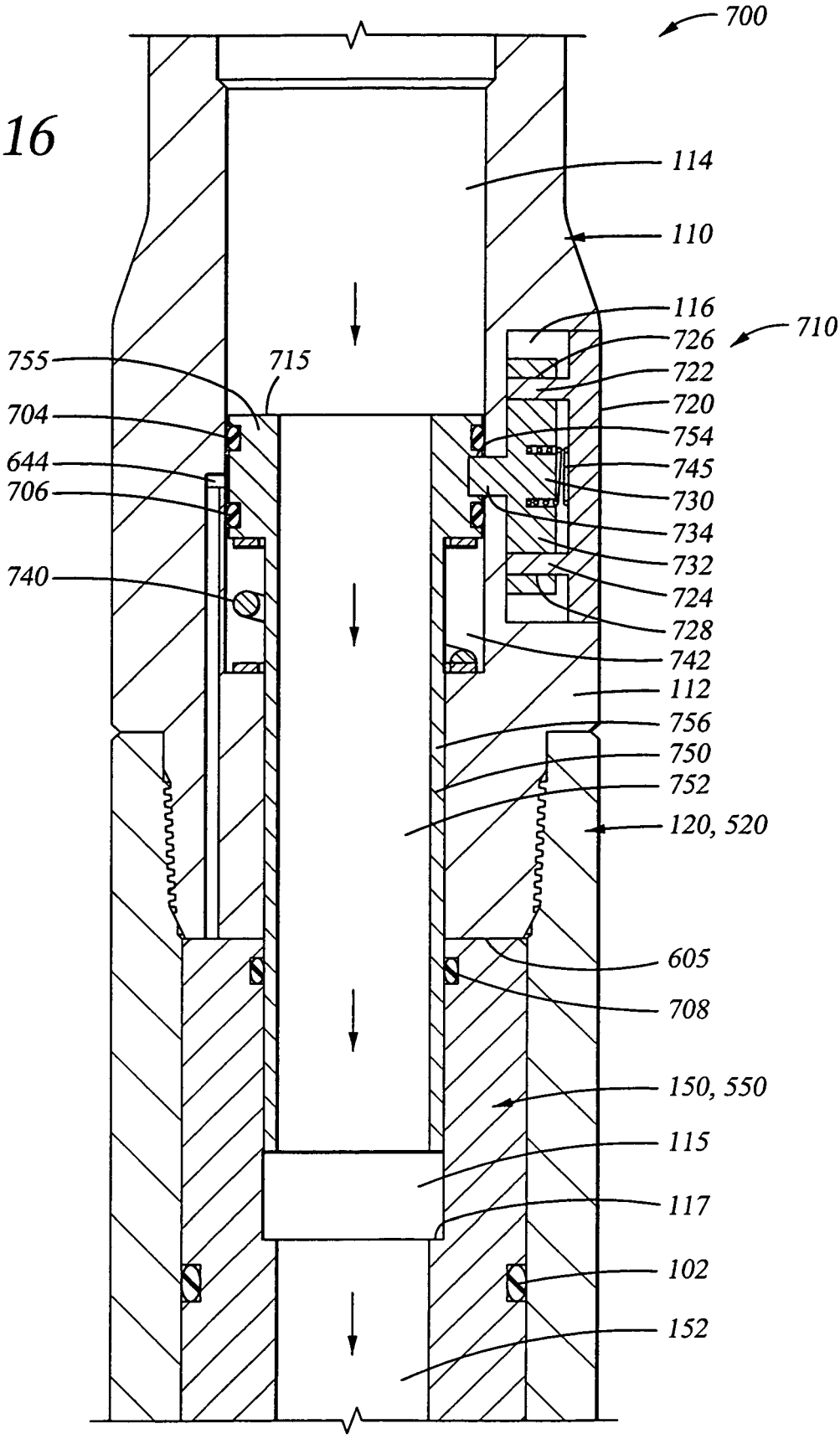
FIG. 16 is a cross-sectional side view of an exemplary centrifugal activation mechanism in the locked position.
Figure 17:
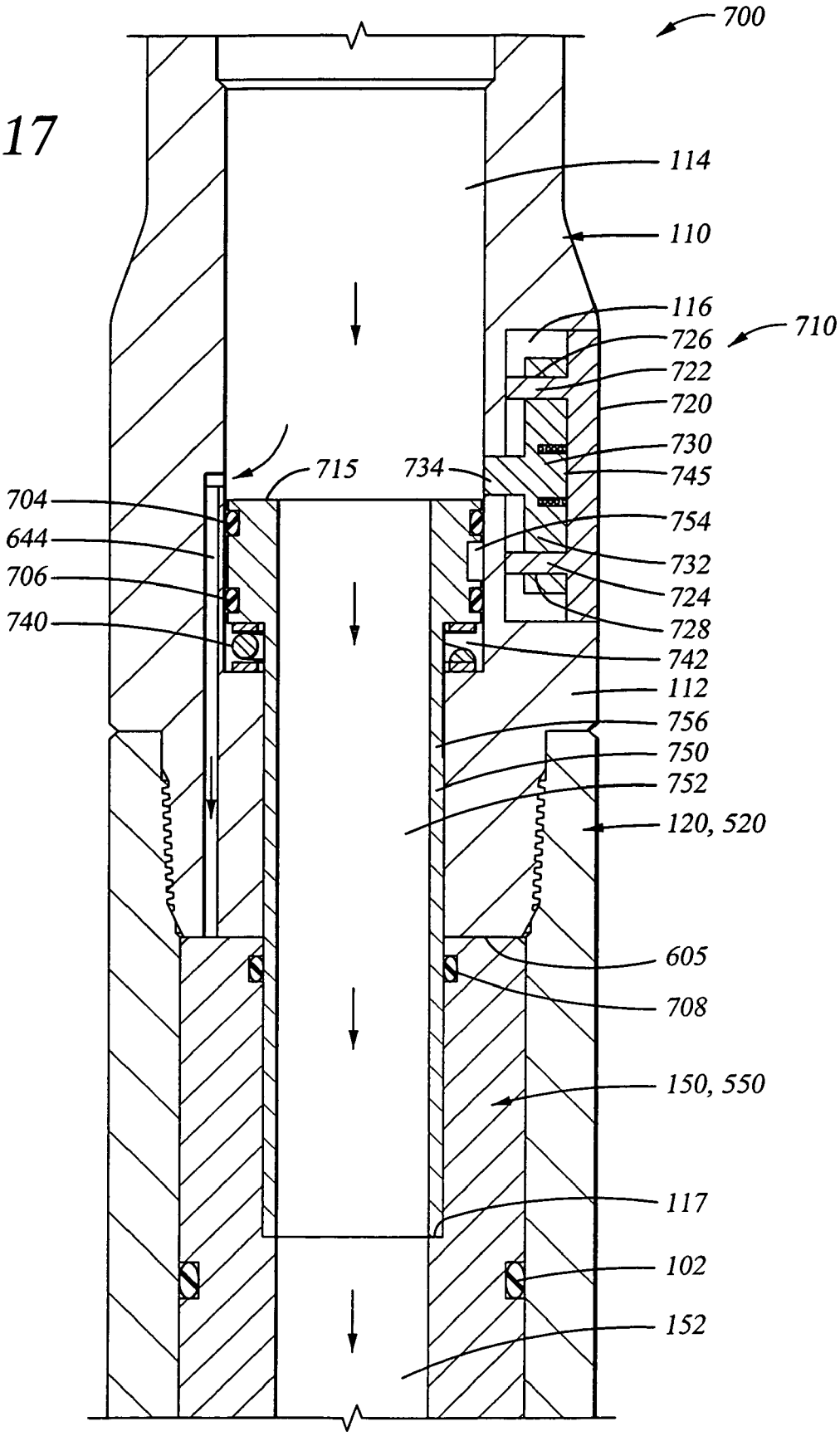
FIG. 17 is a cross-sectional side view of the centrifugal activation mechanism of FIG. 16 in the unlocked position to open fluid ports leading to the tool piston.
Figure 18:
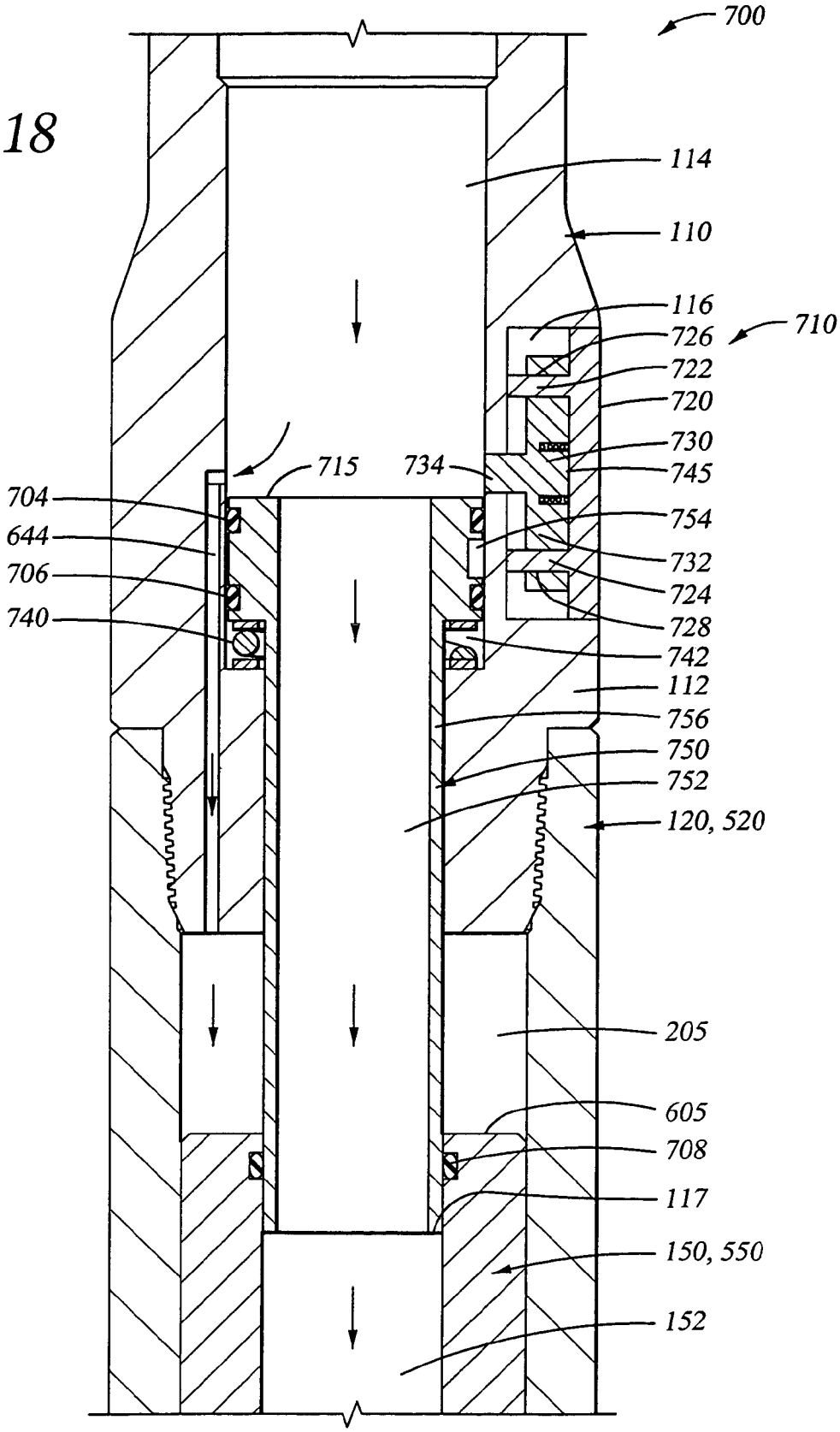
FIG. 18 is a cross-sectional side view of the centrifugal activation mechanism of FIG. 16 in the unlocked position and with the tool piston moved downwardly to expand the tool arms.

FIGS. 16-18 depict enlarged cross-sectional side views of one embodiment of an exemplary centrifugal activation mechanism 700, which allows for selective expansion of the tool 100, 500 without using shear pins 107. In particular, FIGS. 16-18 depict a series of activation steps for the centrifugal activation mechanism 700, which is disposed in the flow bore 114 of the upper 110 section and extends into the flow bore 152 of the tool piston 150, 550. The centrifugal activation mechanism 700 comprises a sliding sleeve 750 biased upwardly by an axial spring 740 disposed in an oil-filled spring chamber 742. The sliding sleeve 750 comprises a plunger portion 755 with a flat upper surface 715 and a side-notch 754 disposed therein, a cylindrical body portion 756, and a flowbore 752 extending through both portions 755, 756. The sliding sleeve 750 extends into an internal recess 115 in the tool piston 150, 550, the recess 115 including a shoulder 117 to limit the downward movement of the sliding sleeve 750. The sliding sleeve 750 sealingly engages the upper section 110 at 704, 706 and sealingly engages the tool piston 150, 550 at 708. Ports 644 extend through the wall 112 of the upper section 110, providing fluid communication between the upper section flowbore 114 and a flat upper surface 605 of the tool piston 150, 550. The centrifugal activation mechanism 700 further comprises a latching assembly 710 disposed in an oil-filled cavity 116 within the wall 112 of the upper section 110. The latching assembly 710 comprises an outer plate 720, a heavy T-shaped member 730, and a radial spring 745. The T-shaped member 730 can move radially and is disposed on linear bearings 726, 728 surrounding guideposts 722, 724 extending from the plate 720.

FIG. 16 depicts the centrifugal activation mechanism 700 with the sliding sleeve 750 in the uppermost, locked position and the piston 150, 550 in its uppermost position, corresponding to the retracted position of the tool 100, 500. The T-shaped member 730 is biased radially inwardly with respect to the plate 720 by the radial spring 745, and a locking portion 734 of the T-shaped member 730 engages the side-notch 754 of the sliding sleeve 750. In this position, the sliding sleeve 750 blocks ports 644 that extend through the wall 112 of the upper section 110 between the upper section flowbore 114 and a flat upper surface 605 of the piston 150, 550.

In operation, the centrifugal activation mechanism 700 will only unlock the latching assembly 710 and allow the piston 150, 550 to move downwardly to extend the tool arms 160, 300 if the drill string (not shown) that connects to the upper section 110 is rotated from the surface before starting the surface pump. In normal drilling practices, the surface pump is started before the drill string is rotated. Thus, if the surface pumps are turned on first, the centrifugal activation mechanism 700 will remain locked as depicted in FIG. 16, and the expandable tool 100, 500 will remain locked in the retracted position.

To unlock the latching assembly 710 as depicted in FIG. 17, the drill string must be rotated before turning on the surface pump. By spinning the drill string at an adequate speed, the centrifugal force acting on the T-shaped member 730 will cause it to slide radially outwardly against the radial spring 745 and along the guideposts 722, 724 aided by the linear bearings 726, 728. It is expected that 120-125 revolutions per minute (RPM) of the drill string will be sufficient to cause the T-shaped member 730 to move radially outwardly and disengage from the sliding sleeve 750. Once the locking portion 734 of the T-shaped member 730 has disengaged from the side-notch 754 of the sliding sleeve 750, then the surface pump can be turned on while continuing to rotate the drill string. Then the sliding sleeve 750 is free to move axially downwardly against the axial spring 740 in response to the drilling fluid pressure acting on the upper surface 715 of the sliding sleeve 750. The sliding sleeve 750 will stop moving downwardly when the lower end of the sleeve body 756 engages the shoulder 117 within the recess 115 in the tool piston 150, 550. The downward movement of the sliding sleeve 750 to the position shown in FIG. 17 open the fluid ports 644 to allow flow therethrough.

FIG. 18 depicts the latching assembly 710 in the unlocked position, with the sliding sleeve 750 moved downwardly to compress the axial spring 740. Fluid is flowing through the ports 644 in the wall 112 of the upper section 110 to engage the upper surface 605 of the piston 150, 550, thereby causing it to move downwardly away from the upper section 110, creating a gap 205. The downward movement of the piston 150, 550 causes the tool arms 160, 300 to extend. Thus, the centrifugal activation mechanism 700 eliminates the need for shear pins 107 because the piston 150, 550 will not actuate until the latching assembly 710 is disengaged from the sliding sleeve 750 by rotating the drill string before operating the surface pumps.

While preferred embodiments of the concentric expandable tool have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An expandable downhole tool for use with a drilling assembly in a wellbore, comprising:

a tubular body;

at least one moveable arm disposed within said tubular body and being radially translatable between a retracted position and a wellbore engaging position;

at least one piston comprising a cam portion that mechanically supports said at least one moveable arm in a radially outward direction in said wellbore engaging position when an opposing force is exerted;

wherein said at least one piston is axially translatable in response to a differential pressure between an axial flowbore within said tool and said wellbore;

a sliding sleeve biased to isolate said at least one piston from a fluid flow in said axial flowbore and said pressure differential, thereby preventing said at least one moveable arm from translating between said retracted position and said wellbore engaging position; and a port in fluid communication with said flowbore and said at least one piston.

2. The tool of claim 1 wherein said tubular body further includes at least one pocket for storing said at least one moveable arm in said retracted position.

3. The tool of claim 1 wherein said at least one moveable arm comprises a plurality of moveable arms.

4. The tool of claim 1 wherein said at least one moveable arm includes at least one set of cutting structures for reaming said wellbore in said wellbore engaging position.

5. The tool of claim 1 further comprising at least one gage pad for stabilizing said drilling assembly in said wellbore engaging position.

6. The tool of claim 5 wherein said at least one gage pad is removable and replaceable.

7. The tool of claim 5 further comprising cutters adjacent said at least one gage pad.

8. The tool of claim 1 further comprising a droppable or pumpable actuator for aligning said sliding sleeve to expose said at least one piston to said axial flowbore.

9. The tool of claim 1 wherein said at least one moveable arm comprises a back-reaming cutter.

10. The tool of claim 1 further comprising at least one nozzle disposed adjacent said at least one moveable arm.

11. The tool of claim 1 wherein said tool comprises a concentric expandable reamer.

12. A method of reaming a formation to form an enlarged borehole in a wellbore, comprising:

disposing an expandable reamer in a retracted position in the wellbore;

expanding at least one movable arm of the expandable reamer radially outwardly into engagement with the formation;

reaming the formation with the at least one moveable arm to form the enlarged borehole;

mechanically supporting the at least one moveable arm in the radially outward direction during reaming;

wherein mechanically supporting comprises engaging the at least one moveable arm with a cam portion of a piston;

flowing a fluid through the expandable reamer;

biasing a sleeve to close a port;

moving the sleeve to open the port;

communicating the flowing fluid to the piston though the port to produce a pressure differential across the piston; and selectively driving the at least one movable arm radially outwardly in response to the pressure differential.

13. The method of claim 12 further comprising back-reaming the formation with the at least one moveable arm.

14. The method of claim 12 further comprising mechanically retracting the at least one moveable arm radially inwardly.

15. The method of claim 12 further comprising flowing a portion of the fluid across a wellbore engaging portion of the at least one moveable arm.

16. The method of claim 12 further comprising providing a pressure indication during or after the at least one moveable arm is expanded radially outwardly.

17. The method of claim 12 further comprising providing stability and gage protection as the reaming progresses.

18. The method of claim 12 further comprising removing a formation engaging portion of the expandable reamer without removing the at least one moveable arm.

19. The method of claim 12 further comprising replacing a formation engaging portion of the expandable reamer without removing the at least one moveable arm.

20. The method of claim 12 wherein the expanding step is performed without substantially axially moving the expandable reamer within the wellbore.

21. An expandable downhole tool for use in a drilling assembly positioned within a wellbore, comprising:

a tubular body including an axial flowbore extending therethrough;

a piston disposed within said axial flowbore having at least one cam portion with a substantially flat surface;

at least one moveable arm engaging said piston; and a port in fluid communication with said flowbore and said piston;

wherein said piston is axially translatable in response to a differential pressure communicated across said body between said axial flowbore and said wellbore;

wherein said at least one moveable arm is radially translatable between a retracted position and an expanded position; and a radial biasing spring to bias said at least one moveable arm to said retracted position wherein said radial biasing spring is adjacent said piston and biases a sliding sleeve to isolate said piston from said axial flowbore, thereby preventing said at least one moveable arm from translating between said retracted position and said expanded position in response to said differential pressure.

22. The tool of claim 21 further including an axial biasing spring to bias said at least one moveable arm to said retracted position.

23. The tool of claim 22 wherein said axial biasing spring is disposed in a spring chamber filled with drilling fluid from the wellbore.

24. The tool of claim 22 wherein said axial biasing spring is disposed in an oil-filled spring chamber.

25. The tool of claim 24 further comprising a pressure compensation system.

26. The tool of claim 21 wherein said tubular body further includes at least one pocket for storing said at least one moveable arm in said retracted position.

27. The tool of claim 21 wherein said at least one moveable arm comprises three moveable arms spaced apart circumferentially around said tubular body.

28. The tool of claim 21 wherein said tool is shorter than about 14-feet long.

29. The tool of claim 21 wherein said tool is approximately 4-feet long.

30. The tool of claim 21 wherein said at least one moveable arm is radially translatable between said retracted position and said expanded position via a combination of hydraulic and mechanical activation.

31. The tool of claim 30 wherein said hydraulic activation comprises changing said differential pressure to axially translate said piston.

32. The tool of claim 30 wherein said mechanical activation comprises said at least one cam portion engaging at least one tapered portion on said at least one moveable arm while said piston axially translates, thereby forcing said at least one moveable arm to radially translate from said retracted position to said expanded position.

33. The tool of claim 21 wherein said at least one cam portion further comprises a tapered piston surface.

34. The tool of claim 33 wherein said tapered piston surface engages a tapered blade surface on said at least one moveable arm as the at least one moveable arm is radially translated from the retracted position to the expanded position.

35. The tool of claim 33 wherein said piston comprises a plurality of said cam portions separated by at least one notch.

36. The tool of claim 35 wherein said at least one moveable arm comprises at least one blade portion that resides in said at least one notch in said retracted position.

37. The tool of claim 21 further comprising a second radial biasing spring adjacent said at least one moveable arm and biasing said at least one moveable arm radially inwardly from said expanded position to said retracted position.

38. An expandable downhole tool for use in a drilling assembly positioned within a wellbore, comprising:

a tubular body including an axial flowbore extending therethrough;

a piston disposed within said axial flowbore having at least one cam portion with a substantially flat surface;

at least one moveable arm engaging said piston; and a port in fluid communication with said flowbore and said piston;

wherein said piston is axially translatable in response to a differential pressure communicated across said body between said axial flowbore and said wellbore;

wherein said at least one moveable arm is radially translatable between a retracted position and an expanded position;

wherein said at least one moveable arm includes a plurality of cylindrical blades; and a sliding sleeve biased to close said port, thereby preventing said at least one moveable arm from translating between said retracted position and said expanded position in response to said differential pressure.

39. The tool of claim 38 wherein each of said blades comprises a fixed blade portion and a removeable blade portion.

40. An expandable downhole tool for use in a drilling assembly positioned within a wellbore, comprising:

a tubular body including an axial flowbore extending therethrough;

a piston disposed within said axial flowbore having at least one cam portion with a substantially flat surface;

at least one moveable arm engaging said piston; and a port in fluid communication with said flowbore and said piston;

wherein said piston is axially translatable in response to a differential pressure communicated across said body between said axial flowbore and said wellbore;

wherein said at least one moveable arm is radially translatable between a retracted position and an expanded position;

wherein said at least one moveable arm engages said wellbore in said expanded position;

wherein said at least one moveable arm includes at least one gage pad for stabilizing said drilling assembly within said wellbore and cutters adjacent said at least one gage pad; and a sliding sleeve biased to close said port, thereby preventing said at least one moveable arm from translating between said retracted position and said expanded position in response to said differential pressure.

41. The tool of claim 40 wherein said at least one moveable arm includes at least one set of cutting structures for reaming said wellbore in said expanded position.

42. An expandable downhole tool for use in a drilling assembly positioned within a wellbore, comprising:

a tubular body including an axial flowbore extending therethrough;

a piston disposed within said axial flowbore having at least one cam portion with a substantially flat surface;

at least one moveable arm engaging said piston;

wherein said piston is axially translatable in response to a differential pressure between said axial flowbore and said wellbore;

wherein said at least one moveable arm is radially translatable between a retracted position and an expanded position;

ports in fluid communication with said flowbore and said piston; and a sliding sleeve biased to close said ports, thereby preventing said at least one moveable arm from translating between said retracted position and said expanded position in response to said differential pressure.

43. The tool of claim 42 further including a bullet actuator for aligning said sliding sleeve to open said ports.

44. The tool of claim 42 wherein each of said three moveable arms comprises a gage surface area.

45. The tool of claim 44 wherein each of said gage surface areas comprises at least one cutting structure and at least one gage pad area.

46. The tool of claim 45 wherein a combination of said gage surface areas of said three moveable arms comprises a complete overlap of an aggressive cutting structure and a complete overlap of a smooth gage pad.

47. The tool of claim 42 wherein said at least one moveable arm comprises a back-reaming cutter.

48. The tool of claim 42 wherein said at least one moveable arm comprises a tapered surface to engage a casing and radially translate said arm from the expanded position to the retracted position.

49. A drilling assembly comprising:

said expandable downhole tool of claim 42.

50. The drilling assembly of claim 49 wherein said expandable downhole tool is positionable anywhere on the drilling assembly upstream of a drill bit.

51. The tool of claim 42 further comprising shear pins that prevent said at least one moveable arm from radially translating to the expanded position until said differential pressure is sufficient to break said shear pins.

52. The tool of claim 32 further comprising at least one nozzle disposed adjacent said at least one moveable arm.

53. The tool of claim 32 wherein said tool comprises a concentric expandable reamer.

54. The tool of claim 32 wherein said tool comprises a concentric expandable stabilizer.

55. The tool of claim 38 further including a latching assembly having a radial spring for unlocking said sliding sleeve to open said ports.

* * * * *